US006749468B2

(12) United States Patent
Avery

(10) Patent No.: US 6,749,468 B2
(45) Date of Patent: Jun. 15, 2004

(54) HIGH-DENSITY CONNECTOR ASSEMBLY MOUNTING APPARATUS

(75) Inventor: Hazelton P. Avery, Batavia, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/307,026

(22) Filed: Nov. 29, 2002

(65) Prior Publication Data

US 2003/0119378 A1 Jun. 26, 2003

Related U.S. Application Data

(60) Provisional application No. 60/386,948, filed on Jun. 7, 2002, and provisional application No. 60/333,865, filed on Nov. 28, 2001.

(51) Int. Cl.[7] ..... H01R 13/502

(52) U.S. Cl. ..... 439/701; 439/608; 439/79

(58) Field of Search ..... 439/701, 79, 608, 439/65, 108

(56) References Cited

U.S. PATENT DOCUMENTS

| | | | | |
|---|---|---|---|---|
| 5,368,505 | A | 11/1994 | Hoolhorst et al. | |
| 5,664,968 | A | 9/1997 | Mickievicz | |
| 5,688,130 | A | 11/1997 | Huang | |
| 5,755,584 | A | 5/1998 | Kodama et al. | |
| 6,083,047 | A | 7/2000 | Paagman | |
| 6,095,852 | A | 8/2000 | Gregory, II | |
| 6,123,554 | A * | 9/2000 | Ortega et al. | 439/79 |
| 6,168,469 | B1 | 1/2001 | Lu | |
| 6,171,115 | B1 | 1/2001 | Mickievicz et al. | |
| 6,183,301 | B1 | 2/2001 | Paagman | |
| 6,196,853 | B1 | 3/2001 | Harting et al. | |
| 6,210,224 | B1 | 4/2001 | Wu | |
| 6,273,762 | B1 * | 8/2001 | Regnier | 439/701 |
| 6,293,827 | B1 | 9/2001 | Stokoe | |
| 6,299,484 | B2 | 10/2001 | Van Woensel | |
| 6,361,374 | B1 * | 3/2002 | Lloyd et al. | 439/701 |
| 6,409,543 | B1 | 6/2002 | Astbury, Jr. et al. | |
| 6,540,522 | B2 * | 4/2003 | Sipe | 439/61 |
| 6,540,558 | B1 | 4/2003 | Paagman | |
| 6,638,110 | B1 | 10/2003 | Billman | |
| 6,641,411 | B1 | 11/2003 | Stoddard et al. | |
| 2003/0119362 | A1 | 6/2003 | Nelson et al. | |
| 2003/0119379 | A1 | 6/2003 | Avery et al. | |
| 2003/0124881 | A1 | 7/2003 | Avery | |
| 2003/0124910 | A1 | 7/2003 | Nelson et al. | |
| 2003/0162441 | A1 | 7/2003 | Nelson et al. | |

FOREIGN PATENT DOCUMENTS

| | | |
|---|---|---|
| EP | 1 049 201 A1 | 11/2000 |
| WO | WO 01/57963 A2 | 8/2001 |
| WO | PCT/US02/38242 -I SR | 11/2002 |

* cited by examiner

*Primary Examiner*—Tho D. Ta
(74) *Attorney, Agent, or Firm*—Thomas D. Paulius

(57) ABSTRACT

Connector assemblies having terminal assemblies which are arranged in side-by-side order are maintained in a group with a desired spacing between the terminal assemblies. The terminals fixed in place at a first point within insulative connector body portions. The terminals assemblies are fixed together by a alignment bar along their lower edges, with the bar having engagement lugs that are received within slots formed in the housings of the terminal assemblies, and they are fixed along their upper edges by a hollow retainer that has a series of slots formed in an interior surface thereof. The slots and the alignment bar are aligned together so that the spacing between adjacent terminal assemblies is even.

19 Claims, 32 Drawing Sheets

FULLY FLEXED IN THE +Y DIRECTION

FULLY FLEXED IN THE −Y DIRECTION

FULLY FLEXED IN THE
– DIRECTION

FULLY FLEXED IN THE
+ DIRECTION

HIGH-DENSITY CONNECTOR ASSEMBLY MOUNTING APPARATUS

REFERENCE TO RELATED APPLICATIONS

This application is a non-provisional patent application that claims priority from U.S. Provisional Patent Application No. 60/333,865, filed Nov. 28, 2001 and U.S. Provisional Patent Application No. 60/386,948 filed Jun. 7, 2002.

BACKGROUND OF THE INVENTION

The present invention relates generally to high density connectors and, more particularly, to high density connectors that are used to connect two printed circuit boards together in orthogonal and other arrangements.

High-density interconnect systems are used in numerous data communication applications, one such application being in network servers and routers. In many of these applications, the interconnect systems include male and female connectors that are mounted to different circuit boards, such as in the manner of conventional right-angle connectors, in which the two circuit boards are oriented at 90° with respect to each other, so that two edges of the circuit boards abut each other. Servers and routers require that the two circuit boards be joined together. In instances where the device system requires the use of multiple pairs of connectors to join the two circuit boards together, problems may occur when one or more of the connectors are misaligned. One, or more, of the connectors on one of the two circuit boards may be misaligned with their corresponding opposing connector on the other of the two circuit boards.

These connectors are not able to move, or "flex" either up or down, side to side or in other directions, which can lead to serious system complications-in that misalignment renders the connecting together of the two circuit boards very difficult, if not impossible. Also, if one connector is misaligned with its opposing mating connector, the mating portions of the connectors' terminals may not mate, thereby deleteriously affecting the performance of the network or router.

High-density connectors typically use pin and box terminal or blade to blade terminal mating arrangements. With these type structures, it is necessary to utilize terminal mating, or contact, portions with reliable lead-ins and alignment features in order to prevent the bending of the terminal contact portions. Bent terminals are a problem in the field of high-density, board to board connectors.

A need therefore exists for a high-density interconnection system that has the capability to move in one and/or two different directions so as to tolerate potential misalignment between opposing circuit board connectors.

A need further exists for a high-density interconnection system including connector assemblies in which the terminal mating portions of the opposing connectors are properly aligned with each other for better mating and have a terminal structure that promotes reliable contact between the opposing terminals.

SUMMARY OF THE INVENTION

The present invention is directed to an improved interconnection assembly that overcomes the aforementioned disadvantages.

Accordingly, it is a general object of the present invention to provide an interconnection system that utilizes a pair of connectors, each mounted near an edge of a respective circuit board and each oriented thereon so that the circuit boards may be spaced near each other and the connector mounted on one of the circuit boards are able to flex a preselected amount, thereby giving to one set of connectors, a measure of flexibility so as to tolerate misalignment between sets of mating connectors.

Another object of the present invention is to provide an interconnection system that utilizes plug and receptacle connectors, the terminals of one of the two connectors being held in place within their associated housings and terminals of the other connector being movable within their associated housing to a preselected extent so as to flex in at least one, and preferably, two different and relevant directions so as to overcome the aforementioned misalignment problems.

A further object of the present invention is to provide a connector assembly with the aforementioned flexure characteristics wherein at least one of the connectors is formed from a plurality of individual subassemblies in the form of wafers support sets of conductive signal and ground terminals and which are arranged in an alternating fashion with respect to the connector terminals such that every grounding member wafer is flanked on opposing sides thereof by an associated signal terminal wafer.

Yet another object of the present invention is to provide a flexible connector for use in the aforementioned connector assembly, wherein the connector includes a plurality of connector wafers assembled together to define a connector body, or housing unit, in the form of a block of wafers, each connector wafer including a set of conductive terminals supported thereby, each of the terminals having a tail portion for connecting to one of the two circuit boards, a body portion supported by the connector wafer, a mating portion extending from one edge of the connector wafer for mating with an opposing terminal of an opposing connector, the mating and body portions, the terminals being interconnected by intervening flexural portions of variable thickness that permits flexing of the terminal mating portions in both vertical and horizontal directions.

Another object of the present invention is to provide a circuit board connector for joining together two circuit boards, wherein the connector has a mating end positioned near an edge of a first circuit board, the mating end having flexural properties that permit the mating end to move in a limited amount in two different directions, preferably orthogonal to each other, the connector having a body portion that supports a plurality of conductive terminals, the terminals having contact or mating free ends that are fixed in place within the connector housing body at the point where their contact portions project from the connector housing body, and which are enclosed by a hollow shroud that encircles the contact free ends, the shroud being supported by supports which cross and link together groups of the terminal contact portions within the shroud so that the shroud and the terminal contact portions can move together as a single unit in at least two different, orthogonal directions, while keeping the terminal contact portions in a mating orientation without relative movement between the contact portions.

Still another object of the present invention is to provide an outer cover assembly that engages the mating end of the flexural connector, the cover assembly including a clamp member that engages the block of connector wafers and serves to keep them together in a block configuration and a floating shroud member that movably engages the clamp member and provides a protective outer cover around the perimeter of the terminal mating portions, the terminal mating portions being partially held in their orientation by elongated dielectric support rails that are received within the cover portion and abut against at least one interior shoulder of the cover portion and which may be held in place thereagainst by one or more key members that are applied to the exterior of the cover and which penetrate the cover to engage and press against the support rails.

Yet still another object of the present invention is to provide a high-density connector for board to board connections in single-ended signal applications, wherein the connector includes a plurality of terminal assemblies assembled together into a single unit, each terminal assembly including a plurality of arrays of conductive terminals, the terminal arrays including at least two signal terminal arrays and an associated single array of ground member terminals, the terminal assemblies being supported on insulative blocks that are held together, the signal terminal and ground member assemblies each including conductive elements with contact portions projecting from a common first side of the respective signal terminal blocks, the ground member having a plurality of conductive tabs formed therein that extend out from the plane of the grounding member in two different directions into contact with selected ground reference terminals of the signal terminal sets, the ground terminals and ground reference terminals flanking individual signal terminals.

Still another object of the present invention is to provide a high-speed, high-density connector assembly that uses a plurality of contact pins projecting forwardly from a connector body, the contact pins being capable of flexural movement and being arranged in a plurality of vertical, linear arrays, each array being separated from an adjacent array by an intervening dielectric spacer element that extends crosswise to the direction of the contact pins and along flexing portions of the contact pins, the spacer element preventing unintentional shorting of the terminals during flexing of the connector and providing a dielectric interface therebetween.

Yet a further object of the present invention is to provide a high density interconnection system that utilizes plug and receptacle-style connectors having terminals with structures that prevent the excessive bending of the terminals when opposing connector components are mated together.

Another object of the present invention is to provide a high-density connector that has a plurality of conductive terminals supported on an insulative housing and wherein the terminals are separated into distinct sets of signal and ground terminals, the ground terminals including double thickness, flat contact blades that project forwardly of the connector body and the signal terminals having contact portion with general L-shapes, the signal terminal being arranged on opposite sides of the ground blades in a cruciform pattern.

A still further object of the present invention is to provide a connector for mating with the high-density connector described above, wherein the signal terminal of this connector include contact portions which are also L-shaped and which include a pair of contact arms that extend in different planes from an L-shaped body portion of the terminals to provide a redundant mating contact with an opposing connector.

Yet another object of the present invention is to provide a high-density, high-speed connector structure which utilizes a double ground to provide both ground reference to signal terminals and isolation between rows of signal terminals.

The present invention accomplishes the aforementioned and other objects by way of its novel and unique structure.

In one principal aspect of the present invention, a flexural high density connector assembly is provided whose primary purpose is to connect together two orthogonally-oriented circuit boards. The assembly includes a plug connector mounted to a first circuit board and a receptacle connector mounted to a second circuit board. One of the connectors, preferably the receptacle connector, includes a structure that permits it to flex in the mating region thereof in both the horizontal and vertical ("X" and "Y") directions. This flexure permits the connector assembly to be utilized in instances where either of the connectors may be misaligned in their mounting positions on their respective circuit boards.

In this regard, and in another principal aspect of the present invention, the receptacle connector includes a plurality of subassemblies, or "tri-wafers," which are assembled together from three different parts and which include two single-ended signal terminal sets flanking a ground terminal set. The terminals sets are supported on dielectric housings and have tail portions extending from one side of the housing which mate with a circuit board, contact portions that extend from another side of the housing for mating with terminals of an opposing connector and body portions interconnecting the contact and tail portions together and which are supported by the housings.

Flexural portions are formed in the terminals and are interposed between the terminal contact and body portions. The flexural portions are located outside of the connector housings as are the terminal contact portions, and they include a center portion of approximately the same width as the terminal body portions, but flanked by two thin neck portions, or flex arms that deflect when needed, while the thicker center portion provides strength and electrical performance to the terminal flexural portions. The terminals may further be aligned together by elongated, vertical support members, preferably molded in place thereon of a dielectric material. These support members preferably take the form of elongated bars that maintain each set or array of terminals supported by a wafer in a fixed spacing and alignment. The support bars fix the terminal contact portions at a pont spaced from a common face of the wafer. The support bars at this point are fixed to a moveable housing, preferably taking the form of a shroud member that thus both the terminal mating portions and the shroud will move as a single unit with respect to the common face of the supporting wafer.

The contact portions of the connector terminals are arranged in linear arrays, and preferably vertical linear arrays. The invention also includes a plurality of dielectric spacers that are interposed between adjacent terminal arrays and these spacer elements take the form, in the preferred embodiment of a planar comb that extends transverse to the axes of the contact portions of the terminals. The spacer element is held in place between adjacent terminal arrays by lugs formed wit the spacer which project into the space between two of the terminals. In this manner, the spacer element will also move up or down or side to side with the terminal contact portions during mating engagement. The spacer element may include means for engaging one of the terminal arrays between which it is interposed, or it may be affixed to the support bars. The dielectric material used in the spacer element affects the electrical affinity of terminal between which it is interposed, and thereby permits a measure of tuning the electrical performance of the terminals, such as impedance, in their flexing portions.

In order to provide effective shielding to the connector of the assembly and in a second principal aspect of the present invention, the inner portion of each connector terminal assembly includes a grounding shield which may be held in a plastic or dielectric frame and in which a plurality of tabs may be stamped. These tabs extend sideways from the plane of the shield and are intended to contact distinct ground terminals that are disposed in the signal terminal sets. The signal terminal sets may be stamped and formed from a conductive material and preferably have an exterior insulative frame, or housing, molded over the body portions thereof. Cavities are preferably formed in the frames into which the grounding shield tabs project to contact their associated grounding terminals of the adjoining signal terminal sets or arrays.

In another principal aspect of the present invention, the signal and ground terminal assemblies and frames are assembled together to form "tri-wafers". These distinct tri-wafers may be separately removed from the entire connector in order to facilitate the removal and replacement thereof. Each such signal and/or ground terminal assembly is supported on a single wafer in one embodiment of the invention and are held together as a unit to form the aforementioned tri-wafer. The center wafer of each such tri-wafer supports a ground terminal assembly and the ground tabs formed therein make contact with terminals of the signal terminal sets that are intended to carry ground signals in the adjoining signal terminal assemblies in a pattern so that each signal terminal in the array of signal terminals will have a ground terminal flanking it in both horizontal and vertical directions.

In yet another aspect of the present invention, a cover assembly is provided that partially encloses the receptacle connector contact portions. This cover assembly includes a clamp member that engages the tri-wafers as a single block, and which forms a support for a shroud member of the cover assembly. The shroud member is provided to form a housing around the receptacle connector terminal mating portions and includes an inner shoulder against which the terminal flexural portion supports, or support bars, abut in contact.

One or more keys, or clips, may also be provided which extend through the shroud in order to press the terminal support bars against the inner shoulders of the shroud. These keys engage the shroud and press against the support bars in a manner to maintain them in contact with an interior shoulder formed in the shroud. The keys preferably have a plurality of fingers or arms that press on the terminal supports, with one finger pressing on the end of a single terminal support bar. Two such keys are utilized to hold the support bars and their accompanying terminals in a fixed position within the shroud and spaced apart from the connector wafer blocks. These keys hold the support bars firmly in place. The shroud may have lead-in surfaces or portions formed therewith that direct either an opposing connector unto the connector or directs the shroud over the mating end of the opposing connector. In this manner, the shroud is permitted to float in its mounting on the clamp member and move as one piece with the terminal flexural portions.

In another embodiment of the invention, the shroud member is slotted in order to align the terminal assemblies of the receptacle connector and in order to space them apart a desired spacing. These slots include cavities which receive engagement keys. The keys extend into the cavities and into the slots to bear against and exert a retention pressure on the terminal assembly support bars.

In still another principal aspect of the present invention, power terminals may be provided in both the plug and receptacle connectors in order to conduct power between the two circuit boards. The power terminals are larger and wider in size to carry an effective amount of current through the connector. The power terminals also include flexural portions that are interposed between their body and contact portions.

In yet another principal aspect of the present invention and as exemplified by another embodiment of the invention, the wafers includes terminal assemblies that include distinct signal and ground terminal sets. The ground terminals include pairs of flat contact blades that are aligned together in abutting contact to form a column of ground contacts blades of double width, when the connector wafers are arranged vertically. The signal terminals are arranged in sets on opposite sides of the ground terminal blades and the signal terminals have a general L-shape. One of the connectors has solid L-shaped contacts that are arranged in sets of two pairs of contacts to form a cruciform pattern. The other of the connectors has bifurcated, or dual beam, L-shaped contacts in which a pair of contact arms (that lie and extend in two different planes) project from a terminal body in a manner so as to mate with the contact portions of the solid L-shaped contacts and to provide redundancy between the opposing contacts.

In another aspect of the present invention, the connector assemblies include a pair of mating connectors and each connector includes a housing that receives and holds together a plurality of individual connector components, preferably in the form of an assembly of wafers. Each wafer may include first and second sets of signal terminals and first and second sets of ground terminals. The signal and ground terminals all include conductive contact portions, tail portions and body portions that interconnect the contact and tail portions together, and the first and second sets of signal terminals being at least partially enclosed by an insulative covering. These two insulative coverings and the first and second sets of ground terminals cooperatively form a single terminal assembly wafer, with all of the terminal assembly wafers in the receptacle connector being of the same type.

The first and second sets of signal and ground terminals have flat blade portions that are arranged within each connector component so that the first and second sets of ground terminals preferably abut each other and extend in a vertical line down the center of the wafer. The first and second sets of signal terminals lie on opposite sides of, or "flank", the first and second sets of ground terminals and the insulative coverings of the first and second signal terminal sets prevent unintended shorting from occurring between the signal and ground terminals. The first and second sets of signal terminals are further arranged so that one pair of first signal terminals and one pair of second signal terminals are disposed on opposite sides of one of the contact portions of the first and second sets of ground terminals. In this arrangement, the L-shaped signal terminal contact portions extend in directions that are both parallel and perpendicular to the ground terminal flat blade portions and the first and second signal terminal pairs form a cruciform pattern around their associated ground blade when viewed from a contact end thereof.

The signal terminal contact portions in this pattern are preferably spaced closer to their associated ground contact blades than they are to the signal terminal contact portion of signal terminals of an adjacent terminal assembly, thereby encouraging signal to ground coupling and discouraging signal to signal coupling from occurring during operation of the connector. In one embodiment, the terminal assemblies are spaced apart from each other and are maintained in such a spacing by both a retainer and the shroud in order to encourage signal to ground capacitive coupling and discourage signal to signal capacitive coupling of adjacent terminal assemblies.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 26 is a top plan view of the wafer assembly of FIG. 25;

DETAILED DESCRIPTION OF THE PREFERRED EMBODIMENTS

Figure 1:
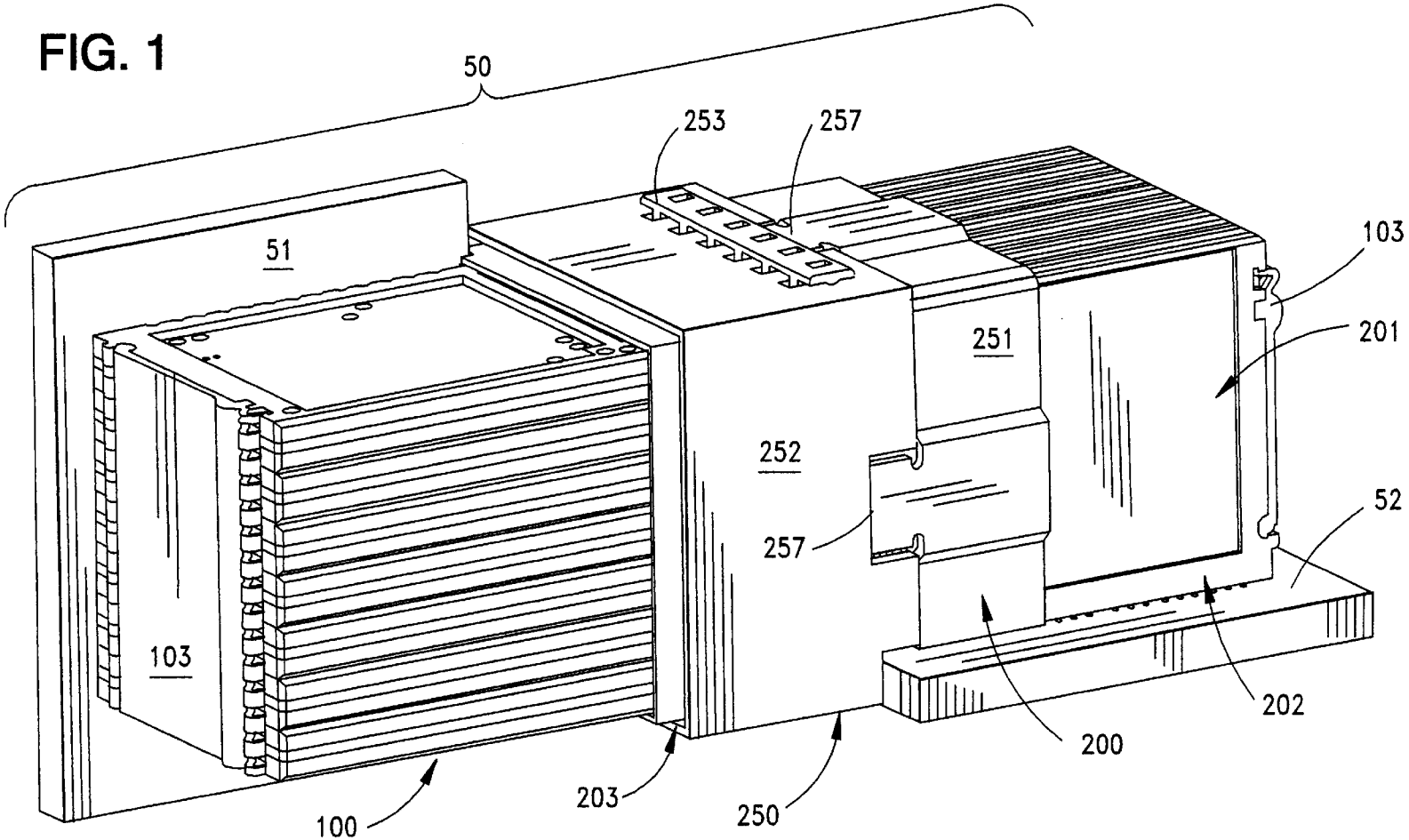
FIG. 1 is perspective view of a single orthogonal connector assembly constructed in accordance with the principles of the present invention, with the assembly including a plug and receptacle connector mated together.

FIG. 1 illustrates a connector assembly 50 constructed in accordance with the principles of the present invention which is primarily useful in connecting two circuit boards 51, 52 together. As shown, the circuit boards 51, 52 are oriented in an orthogonal orientation and it will be understood that only a portion of the circuit boards 51, 52 are shown for clarity. In practice, the horizontal circuit board 52 may have a greater extent in the horizontal plane (into and out of the paper as shown) and may include a plurality of connector assemblies 50 so as to mate with a plurality of vertical circuit boards 51.

The connector assembly 50 of the invention has a structure that permits flexing to occur between the two connectors 100, 200 that are respectively mounted to the circuit boards 51, 52. One of the connectors is a "plug" connector and the other is a "receptacle" connector. It will be understood that in this description, the connector 100 is termed the plug connector because it is received within the receptacle connector 200.

Figure 2:
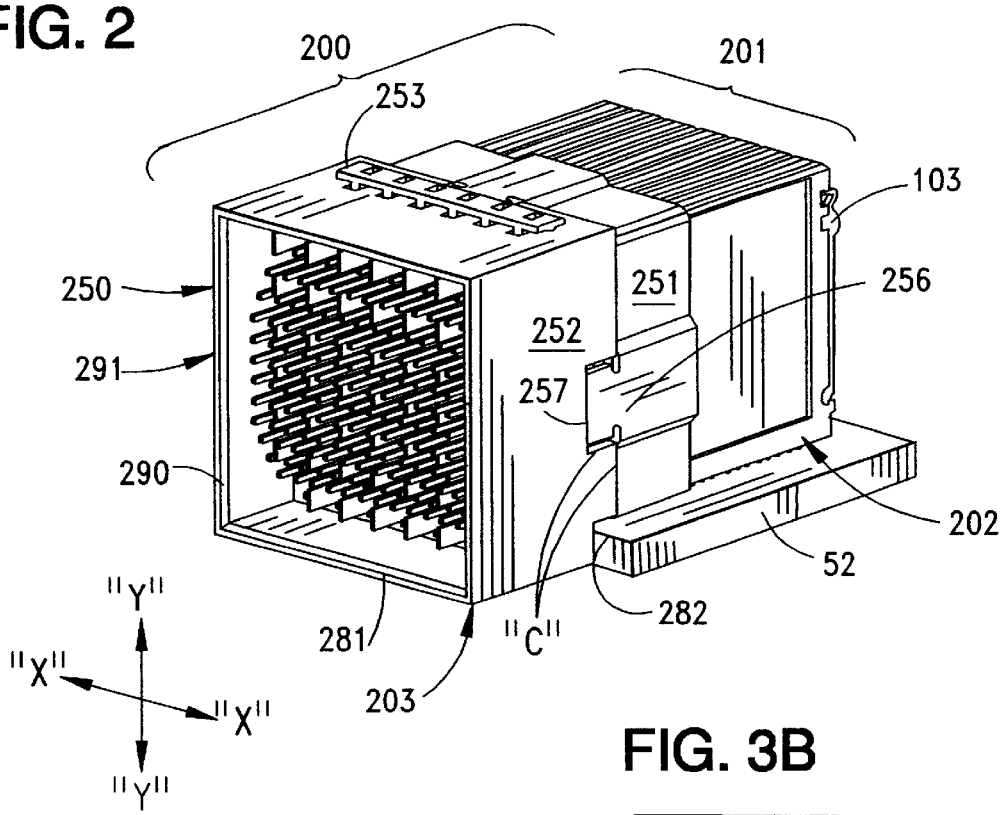
FIG. 2 is a perspective view of the receptacle connector of the connector assembly of FIG. 1.
Figure 3B:
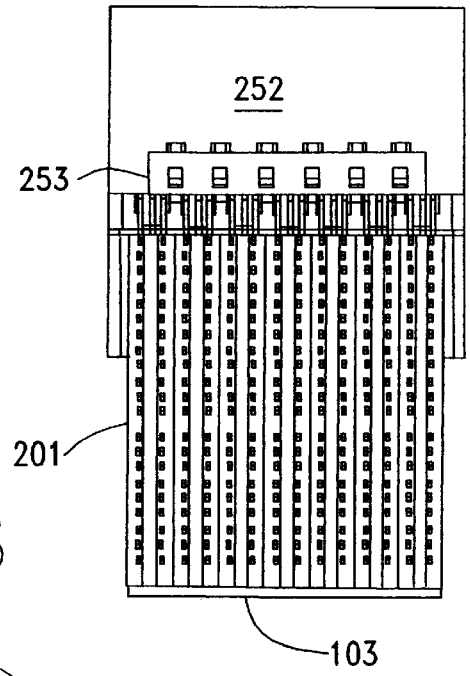
FIG. 3B is a bottom plan view of the receptacle connector of FIG. 2 with the circuit board removed.
Figure 3A:
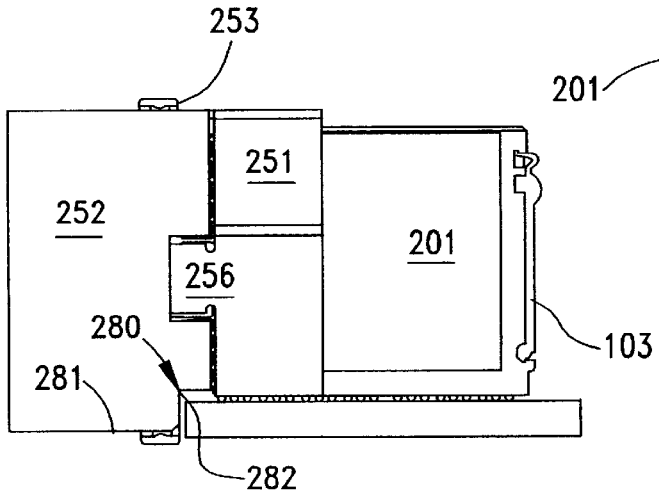
FIG. 3A is a side elevational view of the receptacle connector of FIG. 2.

FIGS. 2–3B illustrate the receptacle connector 200. This connector 200 can be seen to have a body portion 201, a mounting portion 202 that mounts to the circuit board 52 and a mating portion 203 that extends out from the body portion 201 to mate with a like mating portion of the plug connector 100. The mating portion 203 of the connector 200 can move a preselected distance in any one of four directions with in two distinct horizontal and vertical planes, shown in FIG. 2 at the left and the "Y" direction for upward movement, "−Y" direction for downward movement, "X" for leftward movement and "−X" for rightward movement. The extent of this flexure is shown in detail in FIGS. 11–15. Although in the course of this description, the movement of the connectors of the invention will be described in linear terms with respect to the preferred embodiment, i.e. in the common directions of up/down and left/right, it will be understood that the flexural properties of connectors of the invention are not limited only to these four directions, but include radial, diagonal and other directions. Also, it will be understood that although the flexing movement is described only in terms of the receptacle connector, the principles of the invention may be employed to form flexing portions on plug connectors.

Figure 4:
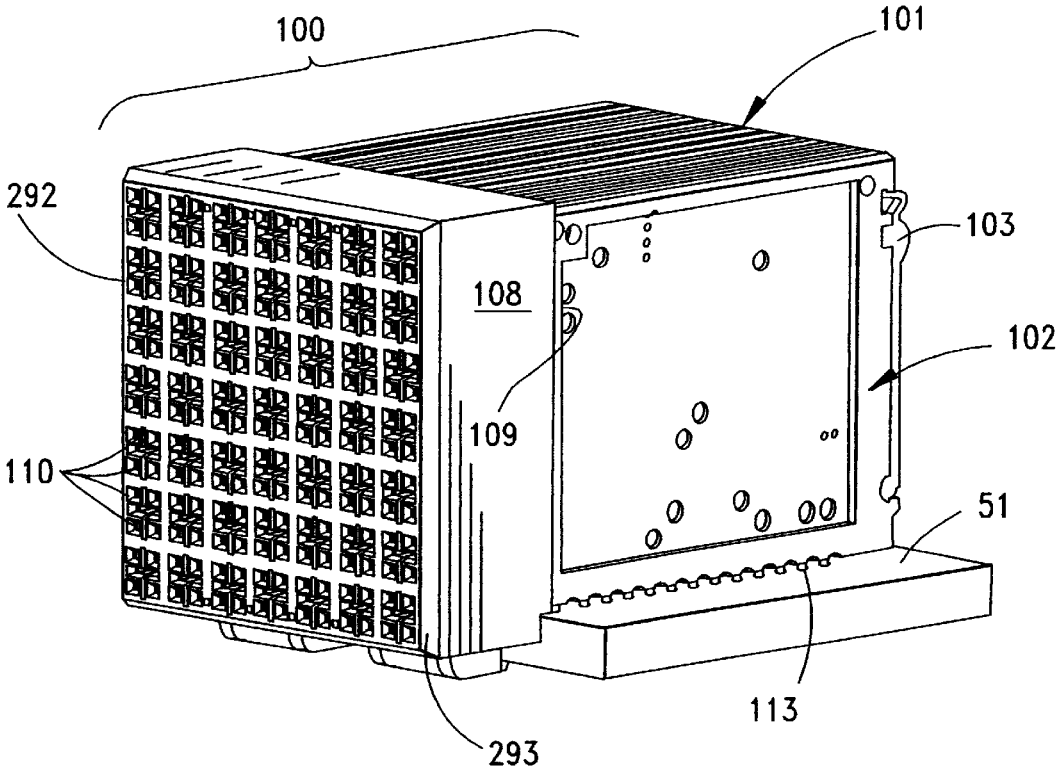
FIG. 4 is a perspective view of the plug connector of the connector assembly of FIG. 1.
Figure 5:
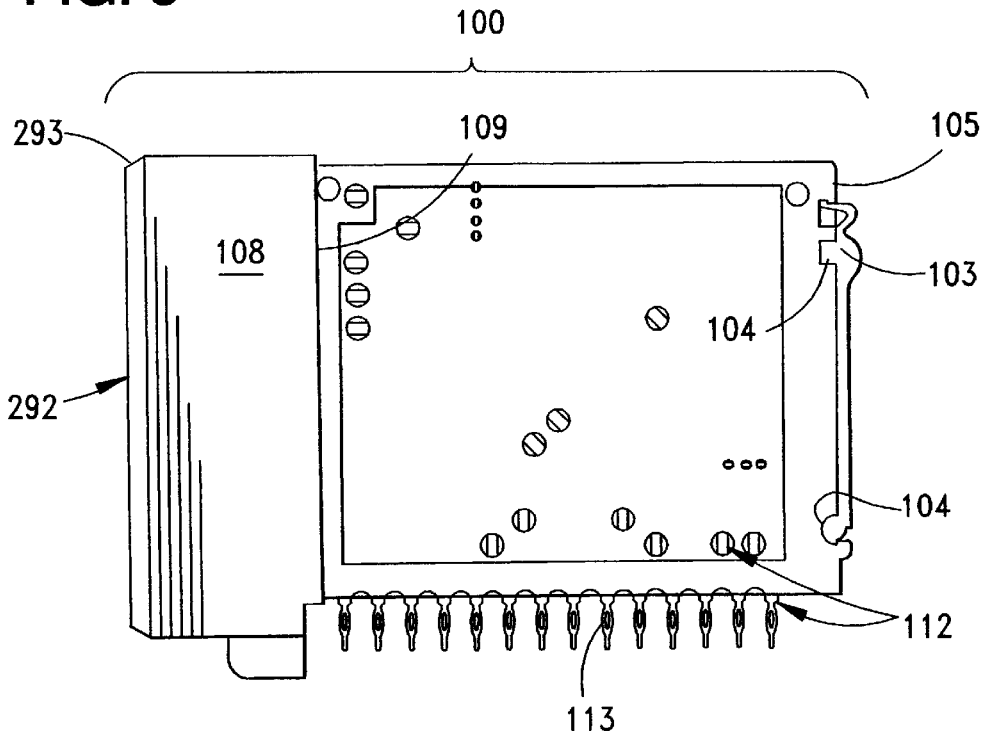
FIG. 5 is a side elevational view of the plug connector of FIG. 4.

The plug connector 100 (FIG. 4) is preferably constructed so it is fixed with respect to the circuit board 51, and it includes a cover portion 108 that is received within the opening of the shroud of the receptacle connector 200. The plug connector 100 is formed from a series of components 101 that are referred to herein as "wafers" because of their relatively thin configuration. These wafers 101 are assembled into a stack, or block 102 of wafers, which are maintained together as a unit by an aligner, or retainer 103, that engages a series of recesses 104 formed in the rear face 105 of the connector block 102. A cover member 108 is also preferably provided to fit over the front, or mating face 109, of the connector block 102 and may have a series of openings 110 formed therein that are aligned with terminal mating, or contact portions (not shown) of the plug connector 100. The terminals 112 of the plug connector 100 may terminate in tail portions, such as the through-hole compliant pins 113 shown, that are received within corresponding mounting holes or vias formed in the circuit board 51. Other means of mounting are also contemplated, such as surface mounting, ball grid arrays, etc.

Terminal Assembly

The wafers of the connectors of the invention are preferably assembled together in groups of three in order to effect single-ended signal transmission and in the order of S-G-S (signal-ground-signal) which means that a ground wafer or member is provided between every two signal wafers. Importantly, when the wafers are assembled in their tri-wafer fashion (as illustrated in FIGS. 6, 9, 10 and 21) they may be removed and replaced as a tri-wafer, or a single terminal assembly, which facilitates the maintenance and repair aspects of connectors of the present invention.

Figure 7:
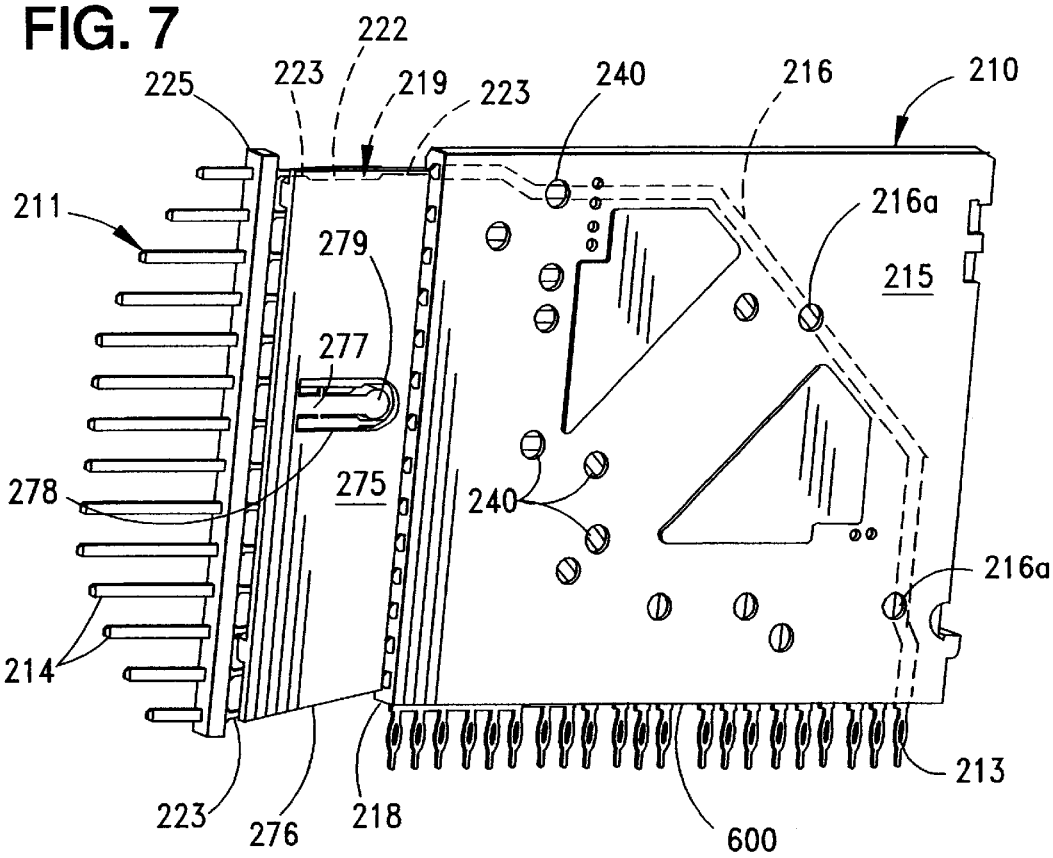
FIG. 7 is a perspective view of a signal terminal wafer used in the receptacle connector of FIG. 6.
Figure 8:
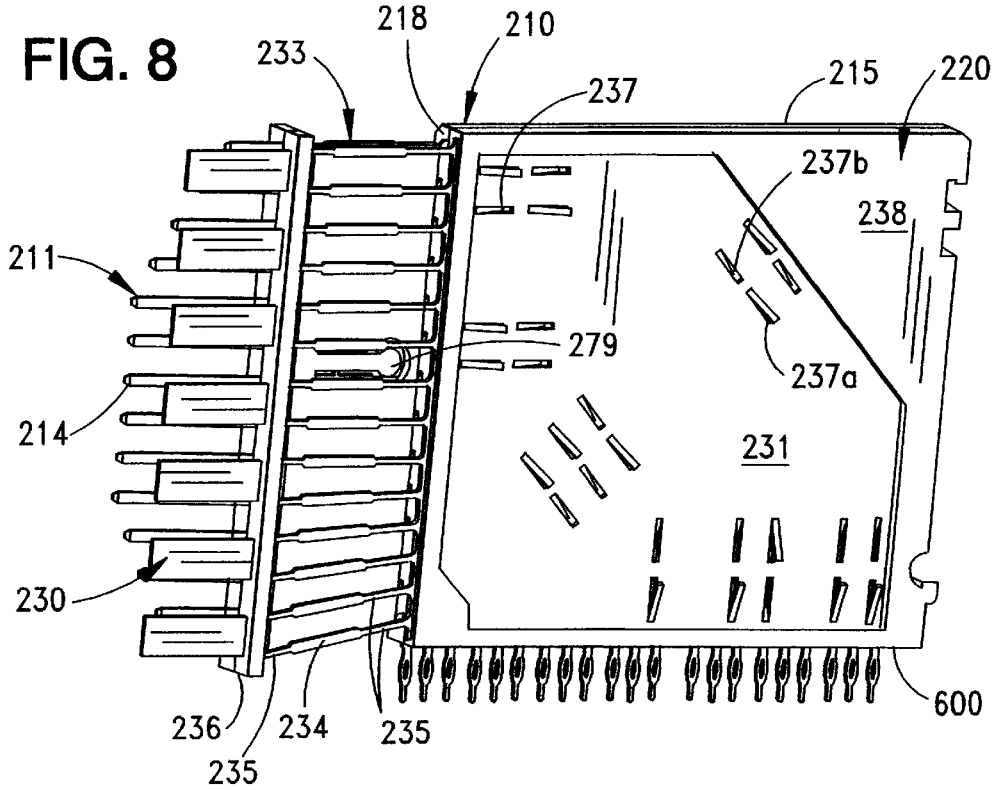
FIG. 8 is a perspective view of the signal terminal wafer of FIG. 7 assembled to a ground terminal wafer.

Turning now to FIGS. 7 and 8, two wafers 210, 220 of the receptacle connector 200 are illustrated. In FIG. 7, a signal terminal wafer 210 is shown, while in FIG. 8, a signal and ground wafer are shown aligned together in an adjoining relationship. It will be understood that an additional signal wafer 210 is missing from the side of the ground wafer 220 that is exposed to view in FIG. 8 and that the terminal assembly of this embodiment on the invention includes two signal terminal wafers on opposite sides of a central ground terminal wafer, as shown exploded in FIG. 9.

The signal terminal wafer 210 supports a terminal set 211 that is termed herein as "signal" terminal set in that it includes terminals that are intended to carry electrical signals and ground reference signals, but it does not include a structure that is intended to act entirely as a ground, such as a grounding shield. The terminals 211 may be stamped and formed into a lead frame and then a housing portion 215 preferably of an insulative and/or dielectric material, is formed about them such as by insert molding, overmolding or other suitable technique. Each terminal has a tail portion 213 for mounting to a circuit board 52 and a contact portion 214 that also projects from one edge, or face 218, of the housing (or wafer) 215 for mating with an opposing contact of the plug connector 100. The tail portions 213 also project along another edge, or face, 600 of the housing 215. These two tail and contact portions are interconnected by intervening terminal body portions 216 (shown in phantom in FIG. 7), which define an electrical path through the terminals between the contact portions 214 and the tail portions 213.

Figure 9:
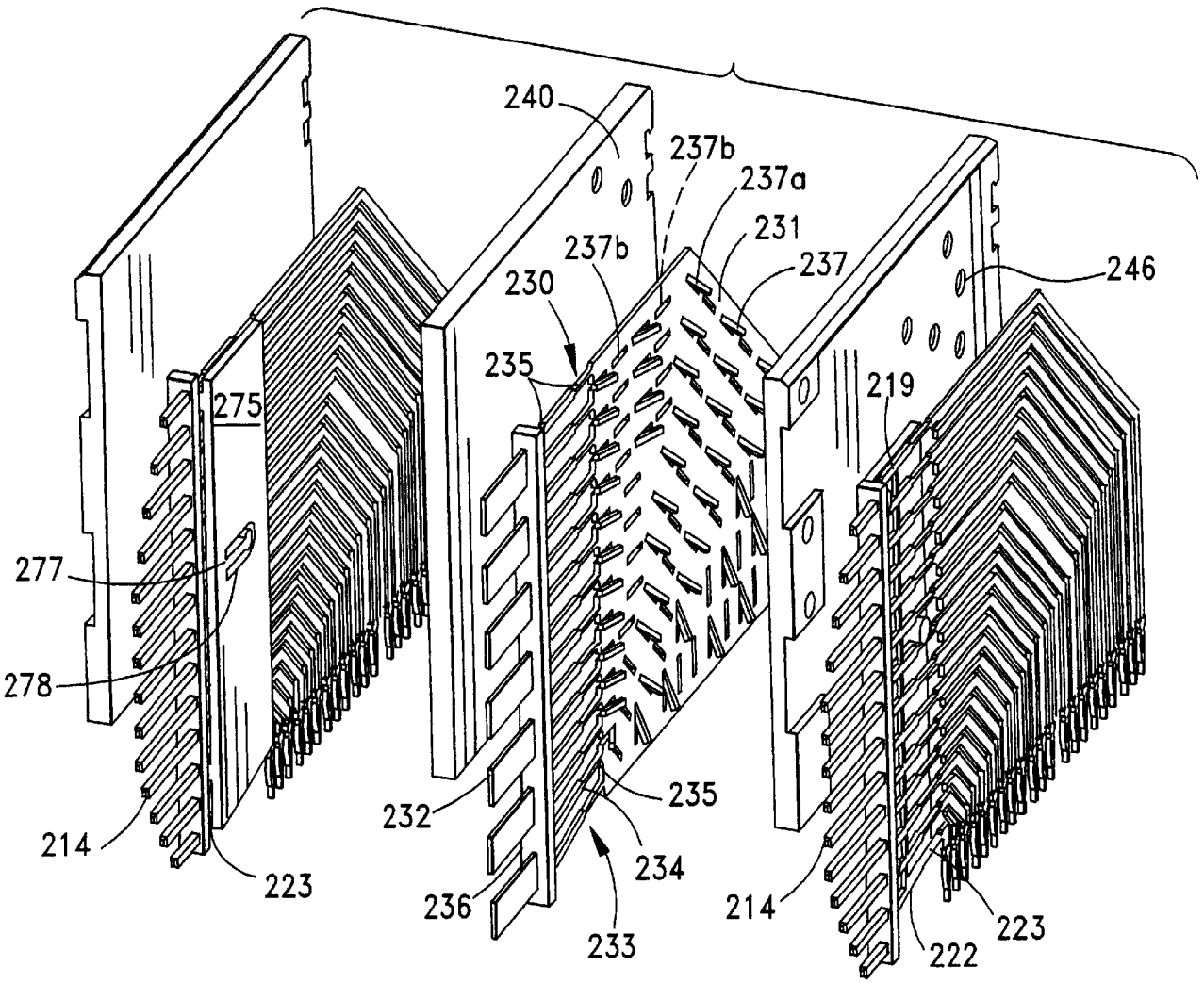
FIG. 9 is an exploded view of one of the receptacle connector tri-wafers.

Parts of the terminals in the mating region thereof that protrude past the front face 218 of the connector wafers/housings 215 may be considered as defining flexing or flexural portions 219 that are interposed between the contact portions 214 and the terminal body portions 216 or the wafer front face 218. As seen in FIGS. 2, 8 and 9, this flexing portion 219 includes a central body 222 that has a thickness and width that approximates that of the terminal body portion 211. This body 222 is flanked by two thin necks, or flex arms 223, that have a vertical width (or thickness) less than that of the terminal contact, center body or body portions (214, 222, 216). This reduction in size increases the resiliency of the flexing portion 219, while the thicker body portion 222 provides strength and also affects the electrical characteristics of the terminals through the flexing portions. It increase capacitive coupling between the signal and ground terminal flexing portions which will result in a decrease in impedance in this area of the connector. It also increases electrical isolation of the signal terminals on opposing sides of the arrays of ground terminals. The sizes of the bodies of the flexing portions may then be dimensioned so as to achieve a desired impedance level within this portion of the connector.

Figure 39:
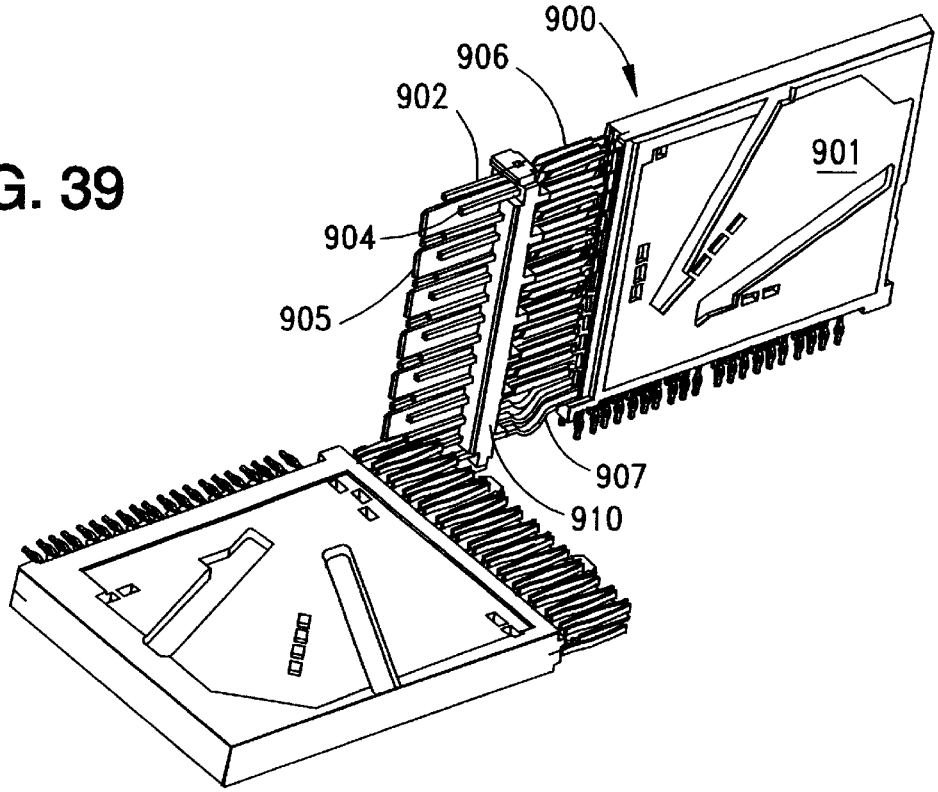
FIG. 39 is a perspective view illustrating the terminal assemblies of FIG. 27 engaged together in an orthogonal connection with one of the terminal assemblies having an alternate flexing portion construction.
Figure 39A:
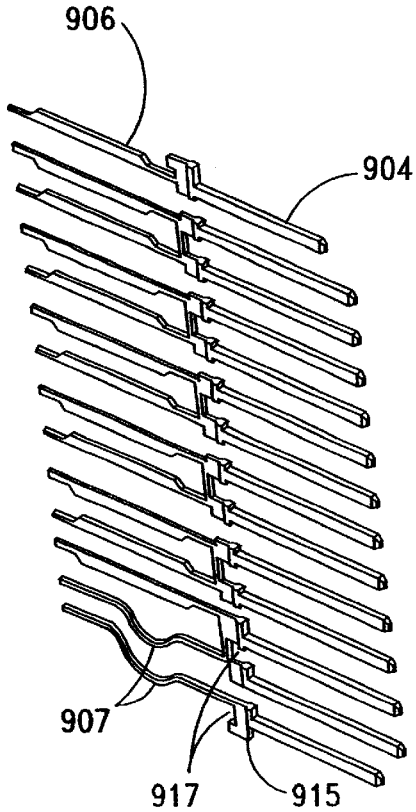
FIG. 39A is an enlarged perspective view of the contact and flexing portions of the flexing terminal assembly of FIG. 39.

The flexing portions are not limited to the structure shown in FIGS. 1–15, but may take other forms. FIGS. 39 and 39A illustrate two opposing terminal assemblies, and in which one of the assemblies 900, has an alternate flexing portion construction. The terminal assembly 900 has a plurality of conductive signal terminals 902, 904 and ground terminals 905 supported by an insulative housing 901. The ground terminals 905 are formed by adjoining ground members which are flanked by signal terminals 902 and 904. The terminals have distinct flexing portions 906, 907 that are separated from the contact portions by an elongated support bar 910 that extends over the terminals. Whereas the majority of the flexing portions 906 are straight and linear, the bottom two flexing portions 907 are shown as arcuate in shape. This is to substantially reduce undesired levels of tension or compression forming in the flexing portions, particularly the lowermost flexing portions, during movement of the connector.

A terminal support member 225, shown as an elongated vertical bar, may be molded onto and over part of the terminal contact portions 214 and its purpose will be explained in greater detail below. As used herein, the terms "mating portions" or "mating regions" refer to the terminal portions that project forward from the front face 218 of the connector wafers, or housings 210, 220. Both the contact and flexing portions of the terminals lie in this mating region, or portion.

The ground wafer 220 (FIG. 8) is constructed in a similar fashion and preferably includes a grounding member 230 that is held or supported by a dielectric or plastic frame 238. As shown in this embodiment, the ground member has contact portions 232, but no tail portions. It relies upon its grounding tabs 237 making contact with designated ground terminals in the signal terminal array that have their own tail portions for connection to the circuit board.

This ground member 230 includes a flat plate or body portion 231 which has terminal contact portions 232 projecting forwardly therefrom. These terminal contact portions 232 are connected to the plate body 231 by intervening flexing portions 233 similar in construction to the signal terminal set flexing portions 219 (FIG. 7), and also include a thick central body 234 that is flanked by two thinner flex arms 235. A vertical support bar 236 may also be provided to hold the ground member contact portions 232 in place in the mating region.

Figure 10:
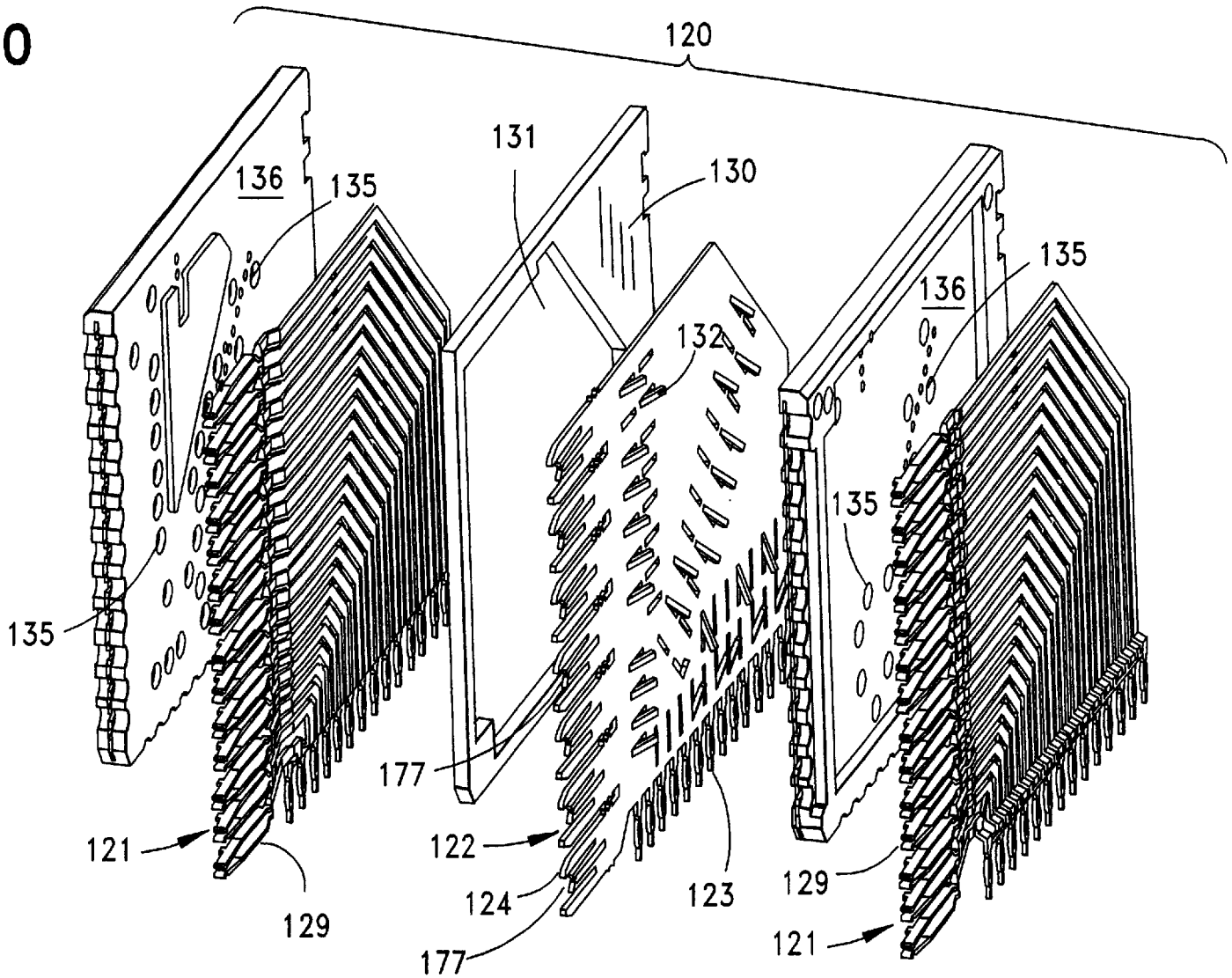
FIG. 10 is an exploded view of one of the plug connector tri-wafers.

In order to provide effective grounding in the overall connector system, the grounding plate 231 is punched, or stamped, to form a plurality of ground tabs 237 that project out from the plate 231. These tabs 237 are preferably located in alignment with specific terminals of the signal terminal set that are designated for carrying ground reference signals, and they project on opposite sides of the grounding plate 231, and as best seen in FIGS. 9 & 10, these grounding tabs extend out from the plane in which the grounding plate 231 extends. The tabs that project to the left of the plate in FIGS. 8 and 9 are designated 237*a*, while the tabs that project to the right of the plate are designated in these figures as 237*b*.

As shown in FIG. 8, the ground terminal set is held in a plastic frame 238 that extends around the perimeter of the plate 231. In order to provide contact with specific terminals of the signal terminal set 211, the frame 215 of the signal wafer is perforated, having openings 240 formed therein. These openings 240 are registered with the terminal body portions 216 so that portions thereof 216*a* are exposed in the openings 240. The grounding tabs 237 of the grounding plate 231 will extend into these openings 240 and contact the exposed terminal body portions 216*a*. As shown in the drawings, these grounding tabs are arranged in a pattern so that they follow the extent of the ground reference terminals in the signal terminal sets through the insulative housings that support the terminal sets. In this manner, the center grounding plate 231 of each tri-wafer acts as an interstitial ground that is "sandwiched" between two signal wafers. With the structure of the signal terminals, such terminals may be arranged in an alternating vertical order of G-S-G-S-G, where the ground reference terminals will flank (vertically) the signal terminals. The terminals of each terminal assembly may then be easily arranged in horizontal row patterns of S-G-S (in rows of "true" signal terminals), and in horizontal row patterns of G-G-G (in rows where the signal terminals are ground reference terminals).

FIG. 10 illustrates a tri-wafer terminal assembly 120 of a different construction which are used in the plug connector 100. In this tri-wafer terminal assembly 120, two signal terminal sets 121 and one ground shield 122 are utilized. The ground shield 122 is interposed between the two signal terminal sets 121 and may include compliant pins 123 and slotted tabs 124 as respective tail and contact portions. The ground shield 122 is held in its own dielectric frame 130 that has a central opening 131 through which its grounding tabs 132 project into contact with designated terminals of the signal terminal sets 121 through openings 135 formed in the dielectric wafers 136 that are molded onto the lead frames of the signal terminal sets 121. The contact portions 129 of the signal terminal sets 121 shown in FIG. 10 are female terminals that receive the pin-style contact portions 214 of the receptacle connector terminals. Likewise, the grounding shield contact portions 124 receive the thick blade contacts of the grounding shield 230 in the slots 177 formed between their contact arms.

Connector Terminal Cover Assembly

Returning now to FIG. 2, the receptacle connector also preferably includes a cover assembly 250, part of which moves with the terminal contact portions as a unit. This cover assembly 250 includes a clamp member 251, shroud 252 and key(s) 253. The clamp member 251 may have an inverted U-shape as shown and is affixed to the block of connector wafers. It does not move, and it assists the wafer aligner 103 in maintaining the connector block as a unit. The clamp member 251 may include legs 256 that project outwardly therefrom and which are used to limit the travel of the shroud 252 on the connector body 201.

Figure 6:
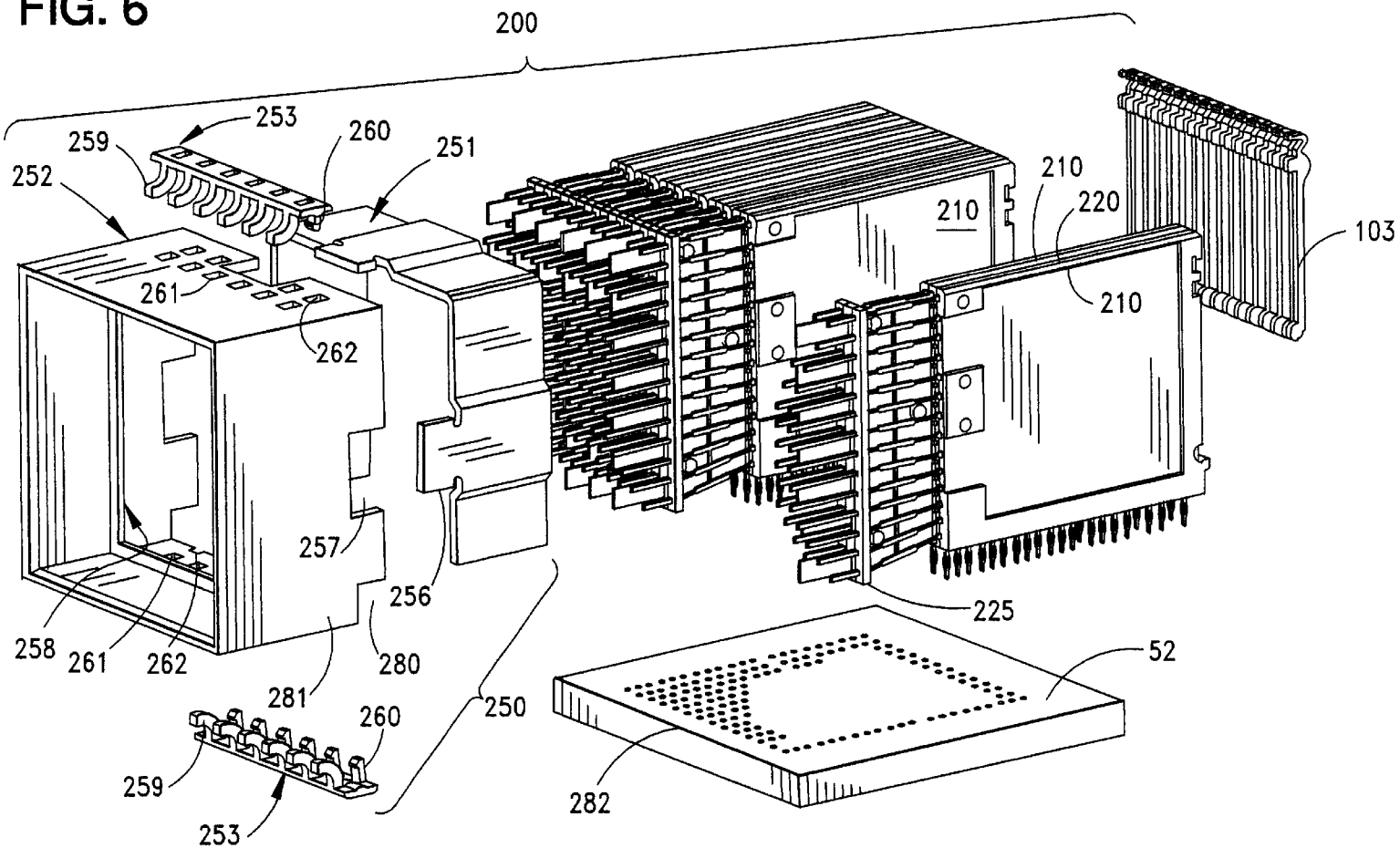
FIG. 6 is an exploded perspective view of the receptacle connector of FIG. 2.

The shroud 252 has a hollow square shape as illustrated in FIG. 6 and it has recesses 259 that are complementary to the clamp member legs 256, with two such recesses being illustrated. It also preferably contains an inner shoulder, or ridge 258 that projects radially inwardly and which is provided to bear against the support bars 225, 236 of the tri-wafers. These support bars 225, 236 are held in contact with the inner shoulder 258 by the cover assembly keys 253 by way of press legs 259 that extend through openings 261 formed in the shroud 252. These press legs 259 are curved so that the keys 253 may be rotated into place. The keys 253 also include retaining clips, or latches 260 that are received in and engage a second set of openings 262 in the shroud 252. In this manner, the support bars 225, 236 are held against the shroud 252 so that the terminal and grounding contact and flex portions and the shroud 252 may move together up/down, right/left and in other directions, and preferably as a single unit.

This flexing movement, as shown in the drawings and particularly FIGS. 11–12 and 14–15 thereof, is effected by fixing the shroud 252 and the terminal mating portions at the support bars 225 together as a unit. The shroud 252 is not attached to the connector block 201 and is free to move, but the engagement of the support bars 225 with the shroud 252 defines a floating point for the terminals, while the connector housings 210, 220, particularly along the front faces 218 thereof, defines a fixed point. Although the shroud 252 is fixed to the terminals at the support bars 225, the support bars 225 are able to move relative to the front face 218 of the connector block 201. In this manner, and as shown diagrammatically in FIG. 12, the flexing sections of the terminals emulate a four-point mechanical linkage with the four points shown as B1, B2, B3 and B4. This arrangement permits desired movement of the contact portions (and the shroud) as a group, while keeping the contact portions 214, 230 in their mating orientations, which is preferably parallel to each other.

Figure 11:
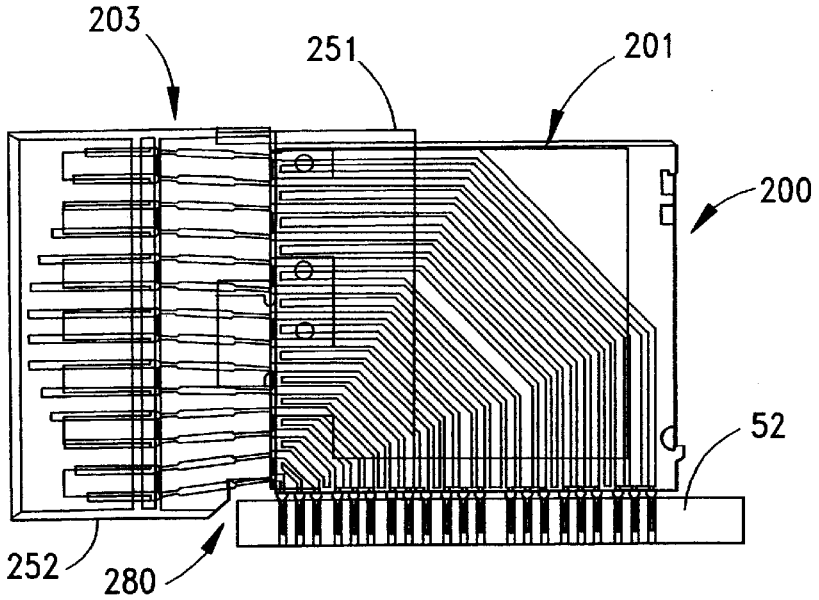
FIG. 11 is a sectional view taken through the receptacle connector of FIG. 2 illustrating the mating portion fully flexed in the upward extent of the "Y" direction.
Figure 12:
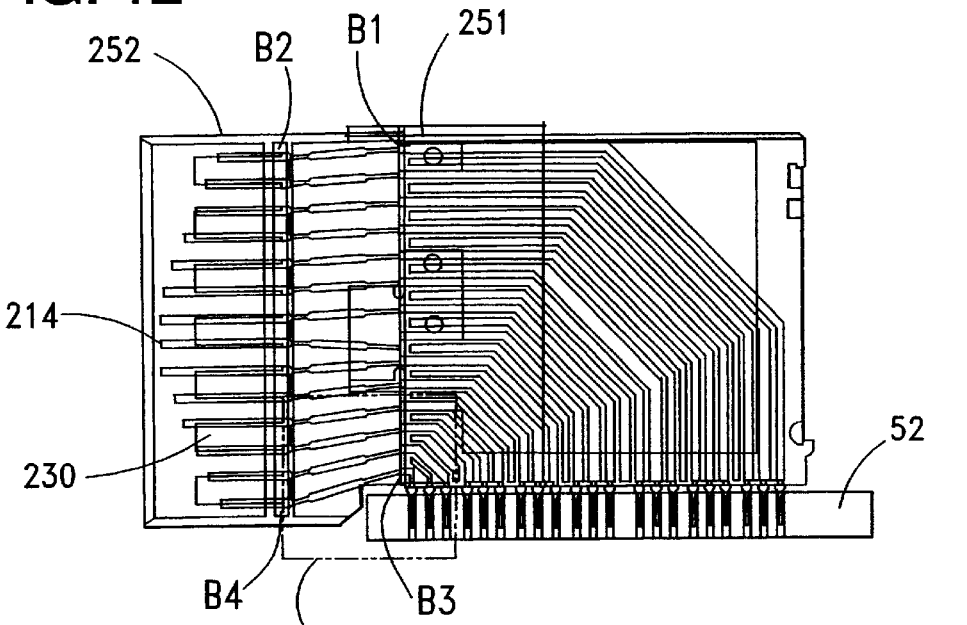
FIG. 12 is a view similar to FIG. 11, but illustrating the mating portion fully flexed in the downward extent of the "Y" direction.
Figure 13:
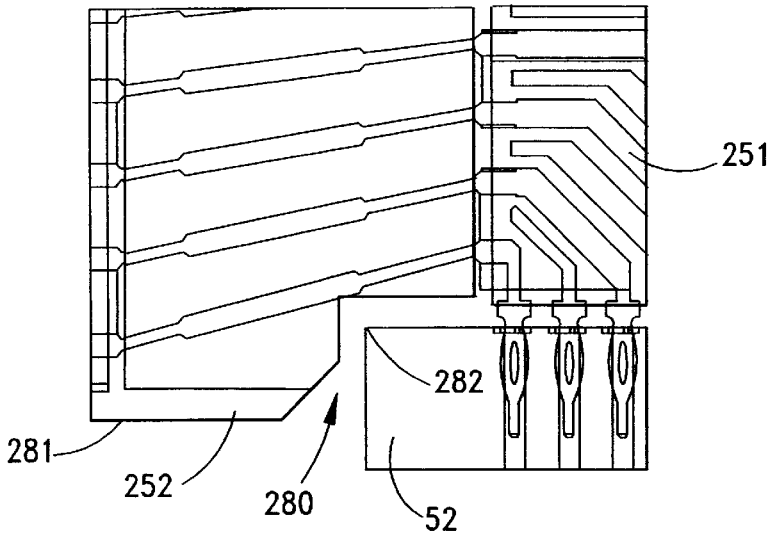
FIG. 13 is an enlarged detail view of the lower part of the flexural section of the receptacle connector.
Figure 14:
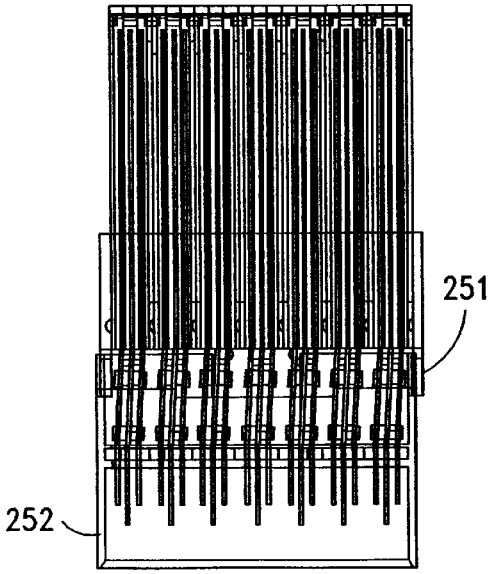
FIG. 14 is a sectional view taken horizontally through the receptacle connector and illustrating the full flexure of the mating portion in one way (direction) of the "X" direction.
Figure 15:
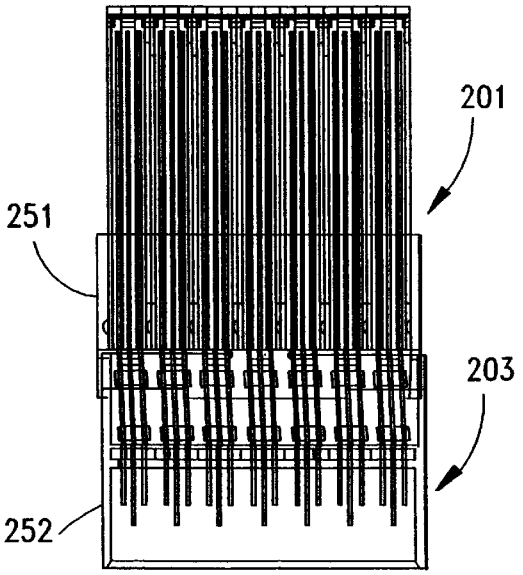
FIG. 15 is the same view as FIG. 14, but illustrating the full flexure of the connector in the opposite (rightward) direction.

FIGS. 11 and 12 illustrate the flexure of the contact portions of the receptacle in the up or "+Y" direction (FIG. 11) and the downward or "−Y" direction. FIG. 13 illustrates the clearance that is effected between the shroud 252 and the circuit board 52. FIGS. 14 and 15 show the maximum flexure that occurs in the receptacle connector in the two different "−X" (left) and "X" (right) directions that occur within a horizontal plane.

In order to provide unimpeded movement of the shroud and mating region of the receptacle connector 200 in these directions, there is a clearance "C" provided (FIGS. 1 & 2) between the clamp member 251 and the shroud 252 so that the clamp member 251 does not impede the movement of the shroud and its contacts. As illustrated in FIG. 13, the shroud 252 may also include a notch 280 formed along the lower face 281 of the shroud 252 that serves to provide a space between the shroud and the edge 282 of the circuit board to which the connector is mounted. (FIGS. 6 and 11–13.)

As shown in the drawings, such as in FIG. 2, the receptacle connector 200 includes an angled surface 290 that preferably extends around the inner perimeter of the face 291 of the shroud 252. This angled surface 290 acts as a lead-in surface and serves to assist in directing the front face 292 of the opposing plug connector (FIG. 4) by way of a complementary angled surface 293 into the interior opening of the shroud 252.

Figure 40:
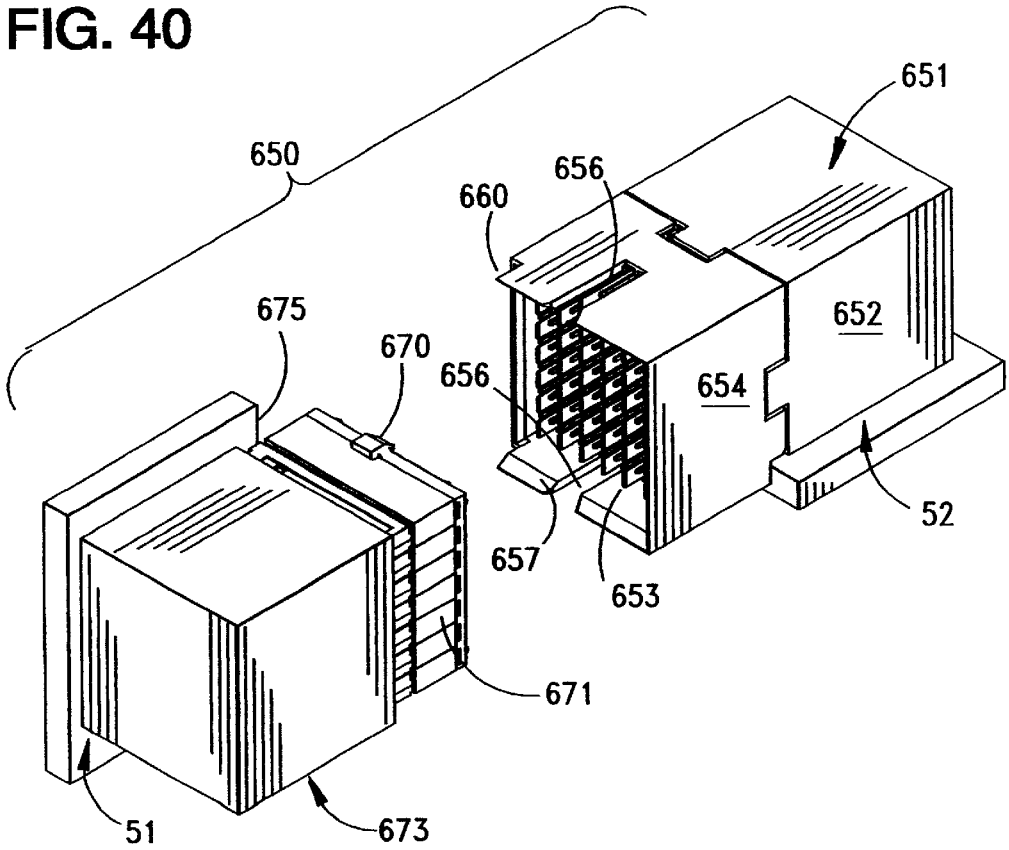
FIG. 40 is a perspective view of an alternate embodiment of the receptacle connector of the invention illustrating an alternate floating shroud construction.

FIG. 40 illustrates another means of orienting the plug and receptacle connectors together. In this embodiment 650, the receptacle connector 651 includes a hollow retainer 652 that holds the terminal assemblies in place together as a unit 653. The front part of the terminal assemblies (not shown) extend out of the retainer 652 and a shroud member 654 is attached to them by way of their support bars (not shown) in the manners described below. The shroud member 654 preferably has one or more slots 656 formed therein, as well as angled lead-in surfaces 657. These slots 656 receive corresponding lugs 670 which are mounted on the cover, or faceplate 671 of an opposing plug connector 673 which is mounted to its own circuit board 51. In this arrangement, it should be noted that the shroud member 654 contains an exterior notch 660 that provides clearance with the edge 675 of the opposing circuit board 51.

Figure 45:
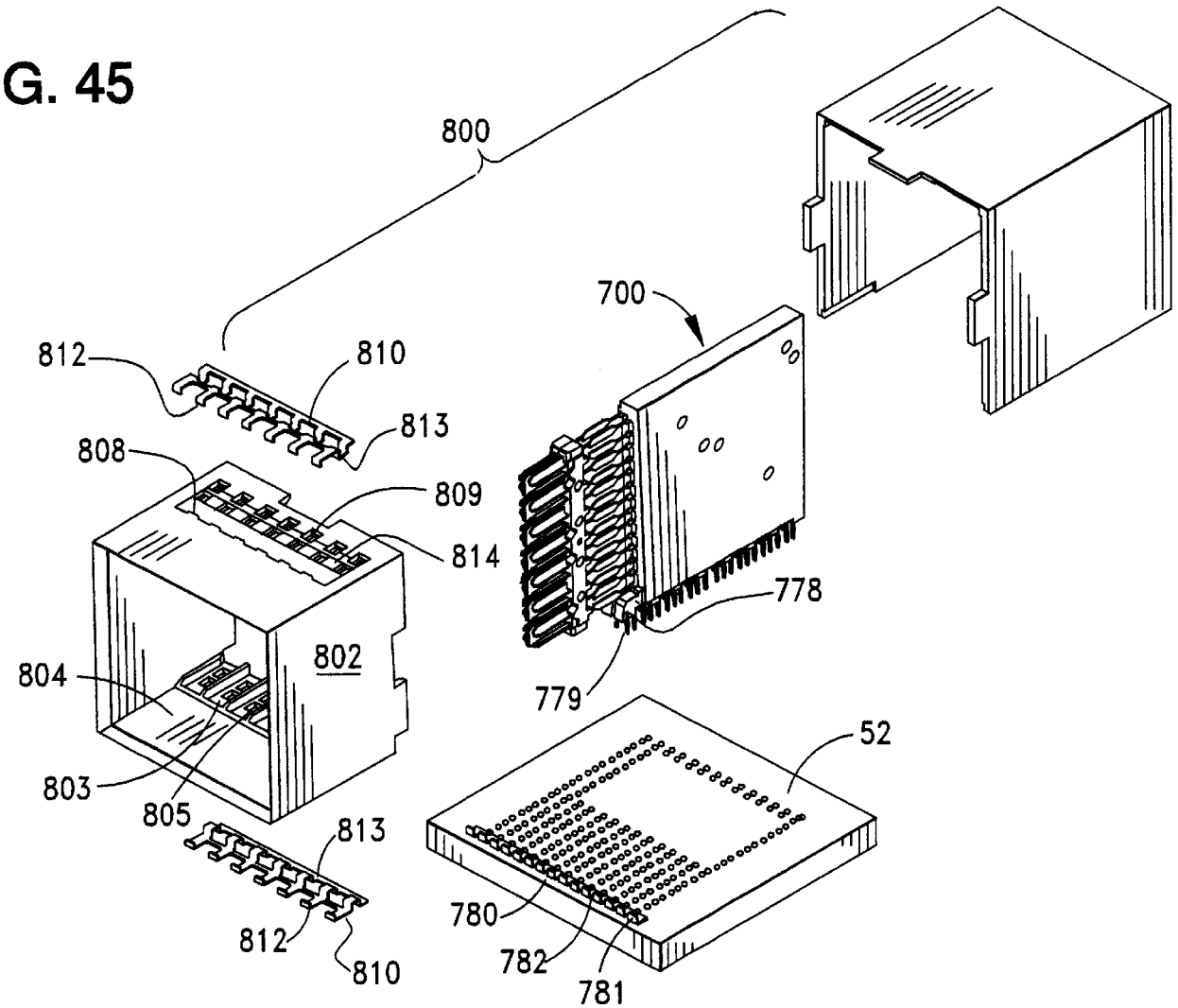
FIG. 45 is an exploded perspective view of an alternate embodiment of a receptacle connector constructed in accordance with the principles of the present invention.
Figure 46:
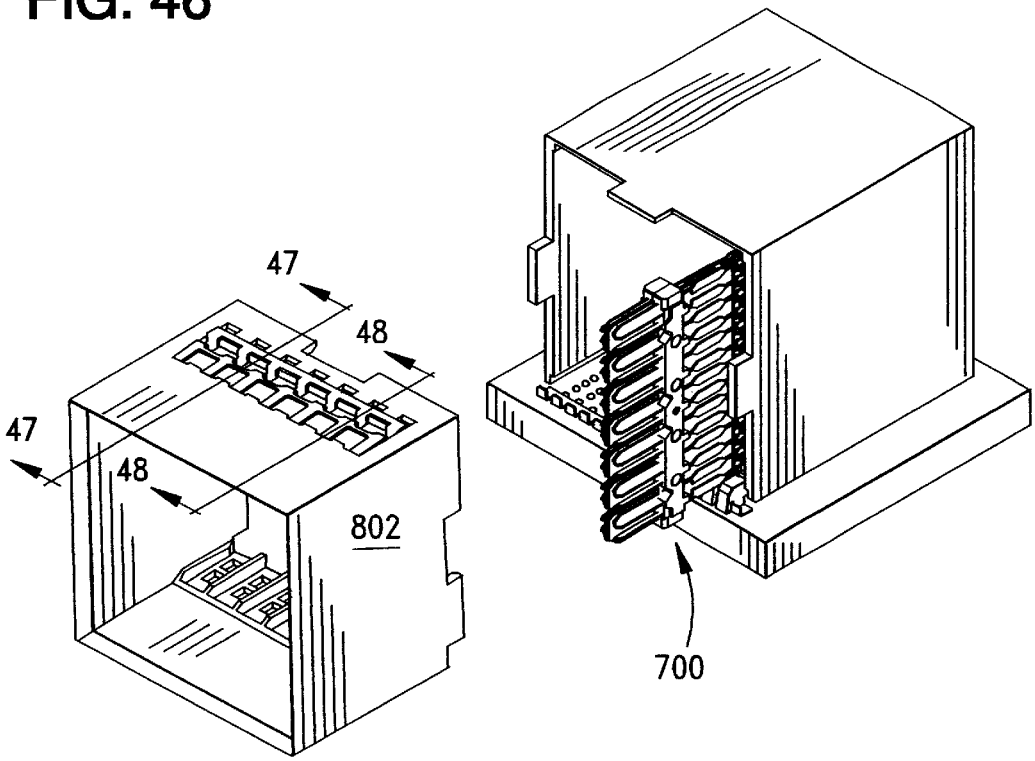
FIG. 46 is the same view as FIG. 45, but with the terminal assembly in place within its retainer and in place on the circuit board.
Figure 47:
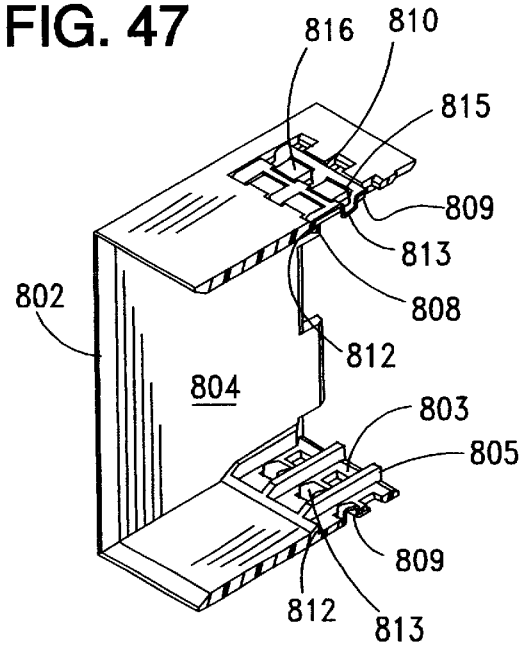
FIG. 47 is a sectional view of the shroud member of FIG. 46, taken along lines 47—47 thereof.
Figure 48:
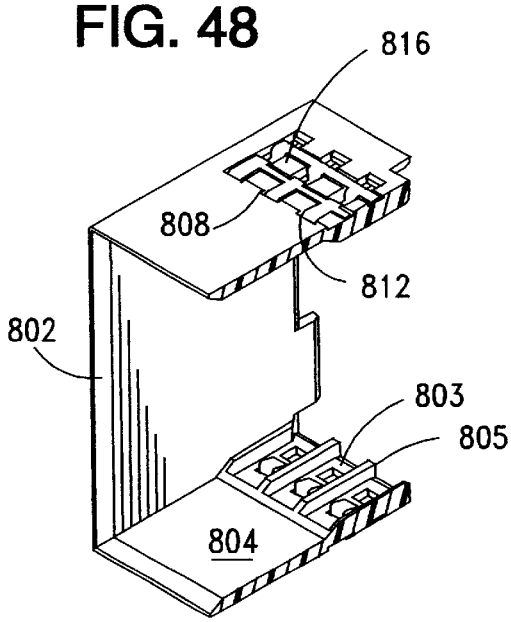
FIG. 48 is a sectional view of the shroud member of FIG. 46 taken along lines 48—48 thereof.
Figure 49:
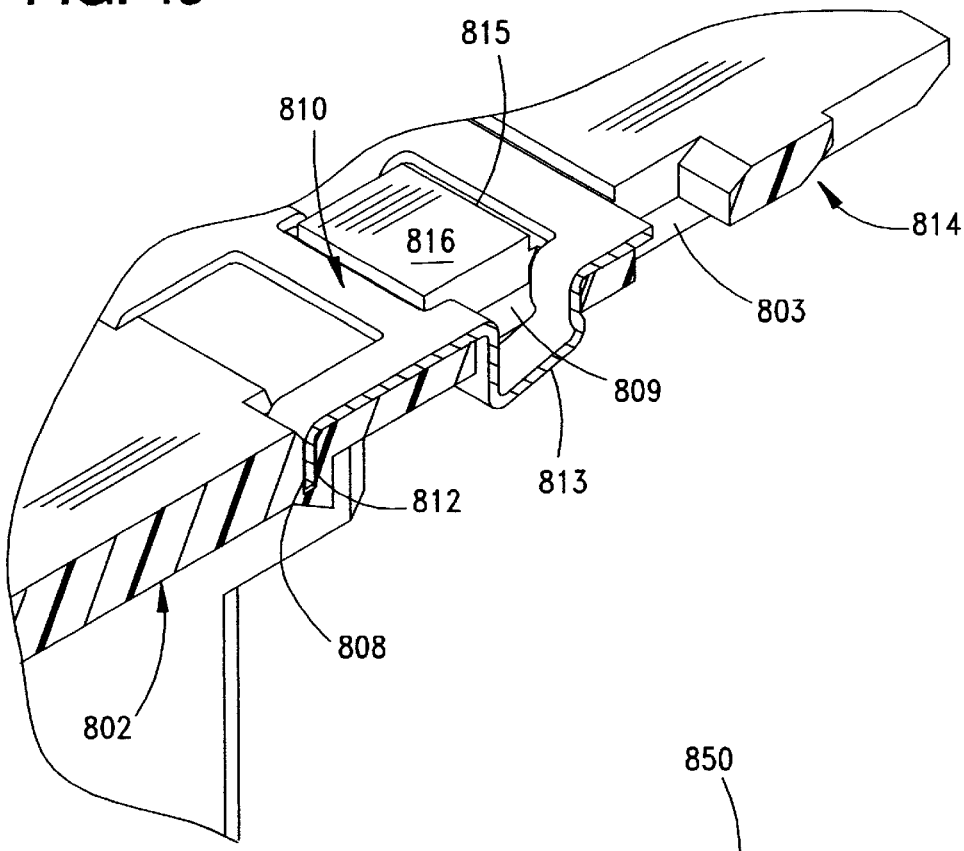
FIG. 49 is an enlarged detail view of a portion of FIG. 47, illustrating the spring key in place within the shroud member.

FIG. 45 illustrates another embodiment 800 of a connector assembly of the invention that uses a different means for retaining the support bars in place to obtain the desired flexing movement. In this embodiment, the shroud member 802 is provided with a plurality of slots 803 formed on its interior surface 804, and which are separated by intervening raised ribs 805. A series of openings 808, 809 are disposed in two opposing sides of the shroud member 802, which are engaged by support bar-retaining clips, or keys 810. The slots 803 are preferably aligned with each other to maintain the support bars in a desired orientation within the shroud member 802 The first openings 808 receive hook ends 812 of the retainer keys 810, while the second openings 809 receive raised spring portions 813. The retainer keys 810 are preferably formed from a resilient metal sheet to give them the desired spring properties, and preferably snap-fit into a slot 814 that runs transverse to the openings 808, 809. This engagement is shown best in FIGS. 47–49. The spring portions 813 extend into their openings 809 and protrude thereinto in order to exert a pressure force on the terminal support bars, and preferably the ends thereof, to hold the support bars to the shroud so they and the terminals supported thereby move together as a unit. These openings communicate with the slots 803 and are aligned in pairs on the opposing sides of the shroud member. The retainer keys 810 also are provided with a plurality of openings 815 disposed between adjacent spring portions 813. These openings fit over protrusions 816 formed in the shroud. (FIG. 49.)

Connector Terminal Supports

Figure 25:
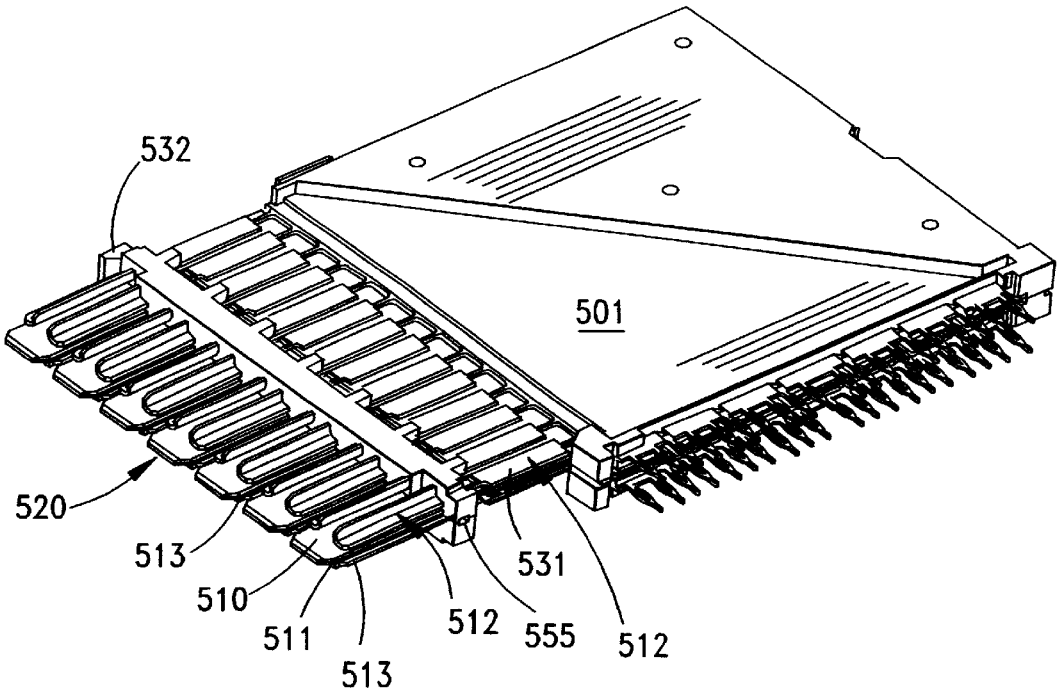
FIG. 25 is a perspective view of the rightmost wafer assembly of FIG. 24.
Figure 26:
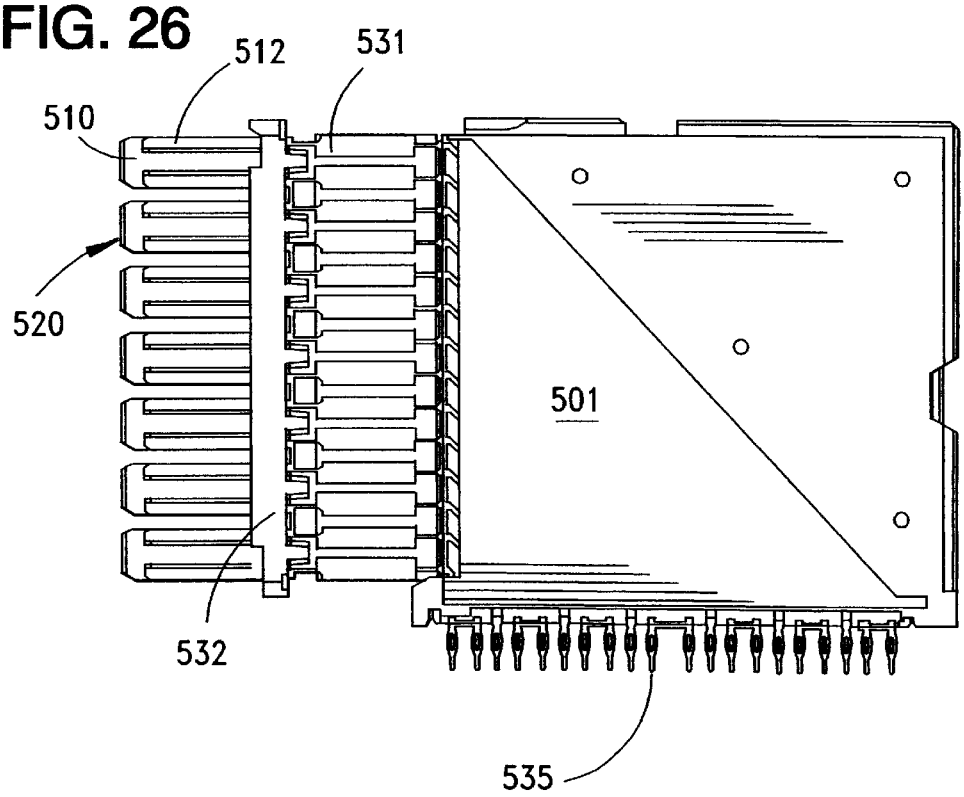
FIG. 26.

As shown best in FIGS. 7 and 8, the support bars 225 are vertical members that extend vertically across, or transverse to the direction in which the signal and ground terminal contact portions of each terminal assembly extend so that they will be vertical in a connector using vertical arrays of terminals and will be horizontal in connectors using horizontal arrays of terminals. As such, they maintain the terminal contact portions of each terminal array in a predetermined contact spacing. The support bars are best applied to the terminals in this embodiment by insert molding, overmolding or any suitable assembly process such as press-fit, adhesives, etc. The support bars then abut each other, as shown in FIG. 8 when the terminal assemblies are assembled together. The abutting edges of these support bars may have means for engaging each other in the form of slots 555 (FIG. 25), adhesive or the like.

An alternate embodiment of the support bars is shown in terminal assembly 700 illustrated in FIGS. 41–44 wherein only two connector housings 701, 702 are used to form a terminal assembly 700, each housing 701, 702 of which, is molded over or around a set of signal terminals 705, such as the L-shaped terminals described to follow. The tail portions of the signal terminal sets 705 and grounding member 707 have been removed in FIGS. 41–44 for clarity and in this embodiment, the grounding member 707 does not use the aforementioned grounding tabs to contact ground reference terminals in adjoining signal terminal sets. In this particular embodiment, two ground members 707 are utilized to obtain a double thickness ground, which is more electrically attractive to the signal terminals that flank it. For these type of terminal assemblies 700, the support bars 708*a*, 708*b* are molded or otherwise formed on the signal terminal mating portions intermediate the flexing portions 709 and the contact portions 710 thereof, which is shown best in the lower right portion of FIG. 41.

These support bars 708*a*, 708*b* have engagement posts, or lugs 712, that project therefrom in a direction transverse to the axial extent of the contact portions of the terminal set 705. These engagement posts 712 extend through openings 715 formed in the ground member contact blades 716 and are received in openings, or recesses 713 formed in the support bar halves 708*a*, 708*b*. The support bar halves 708*a*, 708*b*, as shown in FIGS. 41–44, may also include a recess 725 that receives part 731 of the ground contact portion 716. In this fashion, a snap-fit assembly of the two support bar halves 708*a*, 708*b* may be obtained. Alternatively, the posts and openings may be used in ultrasonically or plastics welding the two support bar halves together. Other means for forming a single support bar from two or more parts, such as adhesives, may also be used.

Isolation and Tuning of Terminals

It should be also noted that the flexing connector may include a dielectric comb or spacer 275 that separates the signal terminal set flexing portions from the grounding terminal set flexing portions within each terminal assembly. Two such spacers 275 are preferably used in each terminal assembly and are shown interposed between the signal terminal wafers 210 and the ground member wafer 220. As shown, the spacer 275 is elongated and generally rectangular, with an angled edge 276 located at its bottom so that, as shown, the spacer 275 extends fully (crosswise) between the top and bottom terminals of the signal and the ground terminal array. The spacer is attached to one of the terminal arrays, preferably the signal terminal array, along the interior face thereof so it extends between the flexing portions of the signal and ground member terminal arrays. The attachment is accomplished by way of an interference fit in the embodiment shown in FIGS. 7 & 8, and the spacer element 275 includes an attachment lug 277 defined in the body of the spacer by way of a U-shaped slot 278. The attachment lug 277 preferably includes an enlarged free end 279 that fits into one of the spaces between a pair of terminal flexing portions in the signal terminal array.

An alternate spacer construction is shown in FIGS. 41–44. This spacer 720 is also planar in configuration and has an extent such that it extends between the top and bottom of the terminal flexing portions. In this manner, the spacer 720 prevents inadvertent shorting between the terminal arrays and it also affects the electrical affinity that the flexing portions of the signal terminal arrays have for the flexing portions of the ground member, and this permits the impedance of the connector to be "tuned' in the flexing portion area. In this embodiment, the spacer 720 is provided with engagement tabs 726 that are preferably received within recesses 728 formed in the support bar portions 708*a*, 708*b*. The engagement tabs 726 may include openings 729 that fit over posts 730 formed on the support bar halves 708*a*, 708*b*. When the two support bar halves 708*a*, 708*b* are assembled together, they hold the spacer element 720 in place between the signal and ground terminal flexing portions.

Flexural Power Terminals

Figure 16:
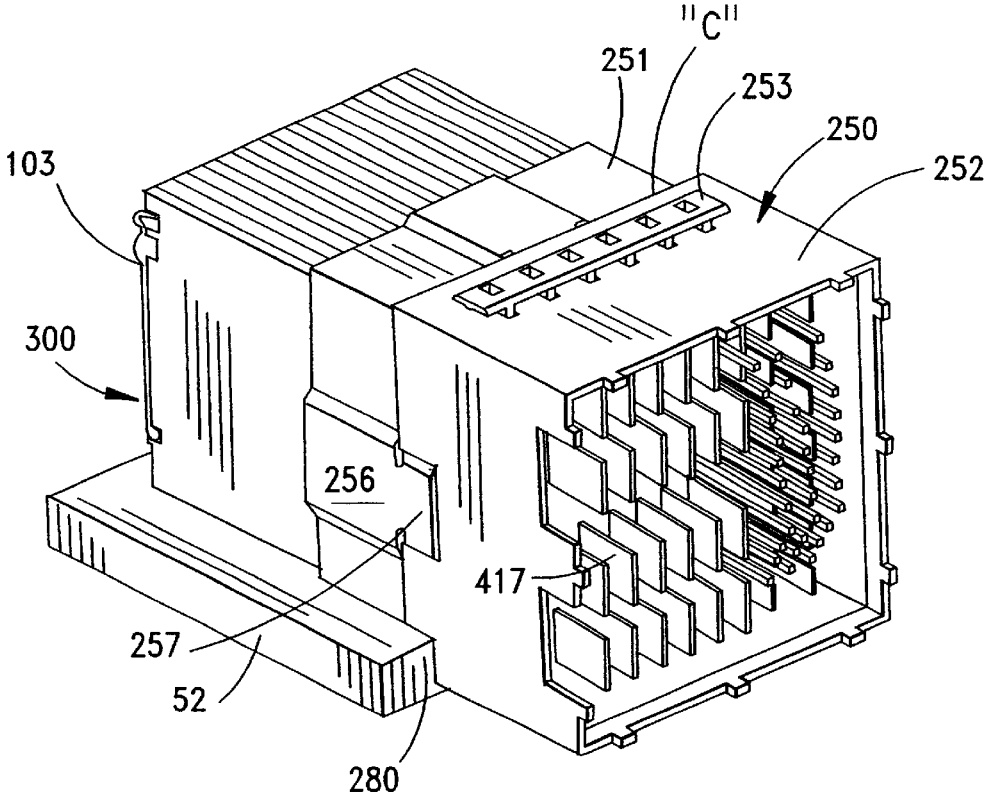
FIG. 16 is a perspective view of an alternate embodiment of a receptacle connector constructed in accordance principles of the present invention and which incorporates power terminals.
Figure 17:
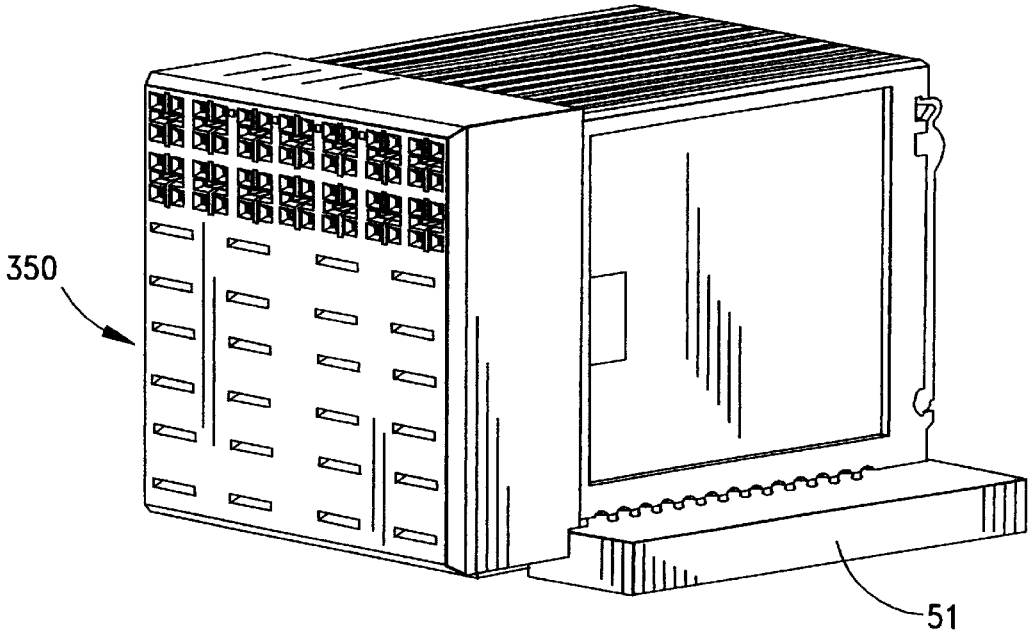
FIG. 17 is a perspective view of an alternate embodiment of a plug connector that mates with the receptacle connector of FIG. 16.
Figure 18:
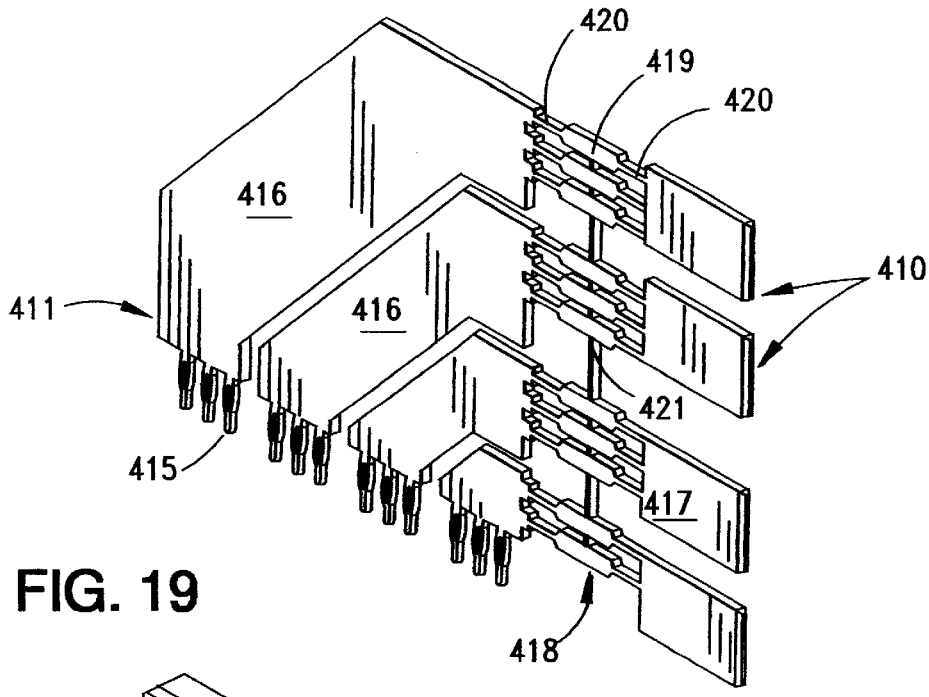
FIG. 18 is a perspective view of a power terminal set lead frame used in the receptacle connector of FIG. 15.
Figure 19:
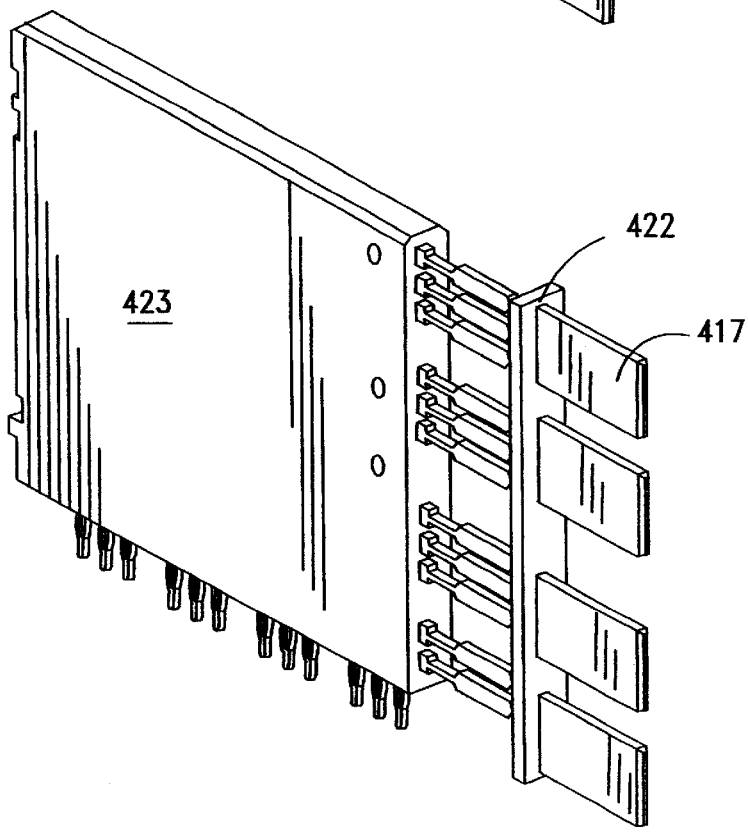
FIG. 19 is a perspective view of the power terminal lead frame with its frame molded onto it.

FIGS. 16 and 17 illustrate alternate embodiments of the invention which incorporate power terminals into the connectors. A receptacle connector 300 is shown in FIG. 16 and it can be seen to have many of the same structural components as the receptacle connector 200 previously described, such as the retainer 103, cover assembly 250, including a shroud 252, clamp member 251 and retaining keys 253. It also includes a plurality of connector wafers that are assembled together as tri-wafers in groups of three, and importantly, it includes a plurality of power terminals 410 (FIG. 18) that are formed as part of an overall power terminal set 411 that are supported by an insulative housing 423. (FIG. 19.).

Each of the power terminals 410 includes a mounting portion 415, a body portion 416, a contact portion 417 and a flexing portion 418 disposed intermediate the terminal body and contact portions 416, 417. The flexing portions 418 include the aforementioned center body 419 which is flanked by two, thin flex arms 420. The power terminal flex portions 419 are interconnected together by a vertical lead 421 during manufacture, and that is stamped and formed with the terminals as illustrated in FIG. 18, but then removed from the terminal lead frame punching. A support bar 422 may be molded to the power terminals as illustrated in FIG. 19 and a wafer body 423 may be molded onto all or part of the power terminal set 411. These power terminal wafers may be positioned near sets of signal and ground terminal wafers, or as illustrated in FIG. 16, along one side of the receptacle connector. The support bars 422 in this embodiment are used to fix the power terminal contact portions 417 to a movable shroud as described above.

Connector Terminal Mating Interface

Figure 20:
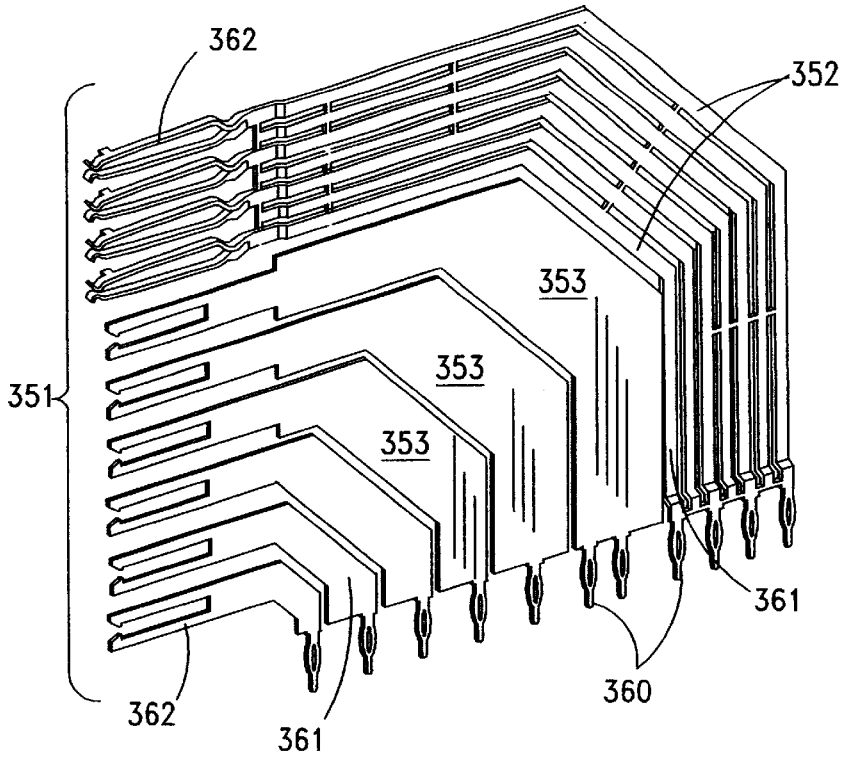
FIG. 20 is a perspective view of the power signal/ground terminal set lead frame used in the plug connector of FIG. 17.
Figure 21:
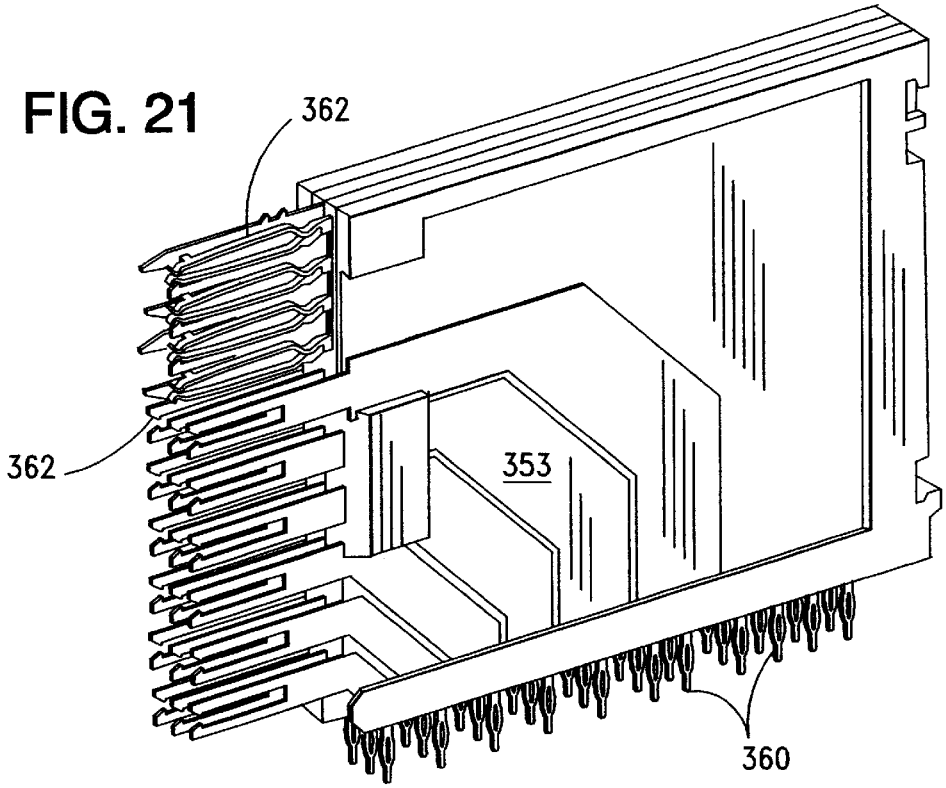
FIG. 21 is a perspective view of the lead frame of FIG. 20 assembled into a plug connector tri-wafer.

FIGS. 20 and 21 illustrate terminal sets that are used with the plug connector 350 of FIG. 17 which mate with the receptacle connector 300 of FIG. 16. The terminal sets 351 include signal terminals 352 that extend alongside a set of power terminals 353. All of these terminals have mounting portions 360, body portions 361 and contact portions 362 and all of them preferably have slotted contact portions that will receive within their respective slots, either the power, ground or signal contacts of the receptacle connector 300. These terminal sets have a dielectric body molded to them and are sandwiched around a grounding terminal set as in the plug connector of FIG. 4. One set of the signal terminals is shown in FIG. 20, while FIG. 21 illustrates a plug connector terminal assembly with a set of ground terminals flanked by two signal terminal sets, each supported by an insulative housing.

Figure 22:
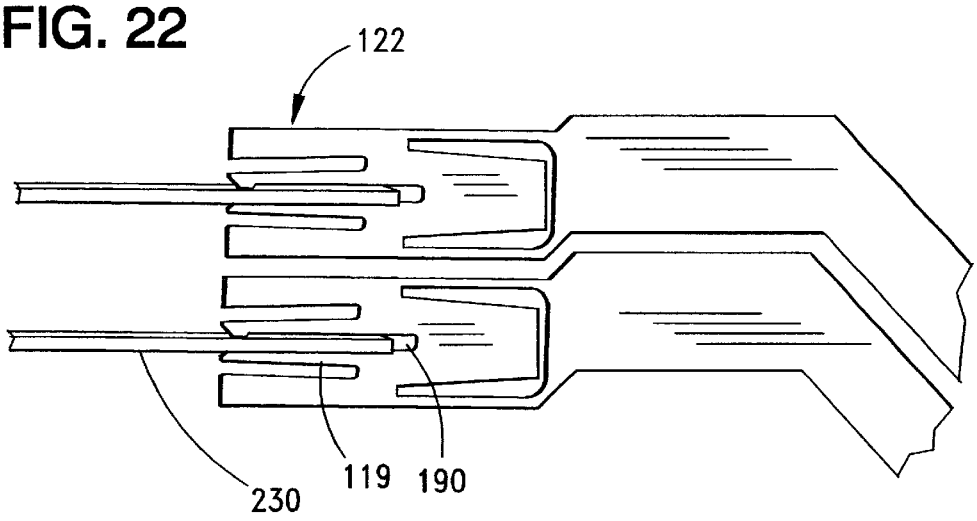
FIG. 22 is a side elevational detail view of the manner of engagement between the grounding shield contact portions of the plug and receptacle connectors of the connector assembly of FIG. 1.
Figure 23:
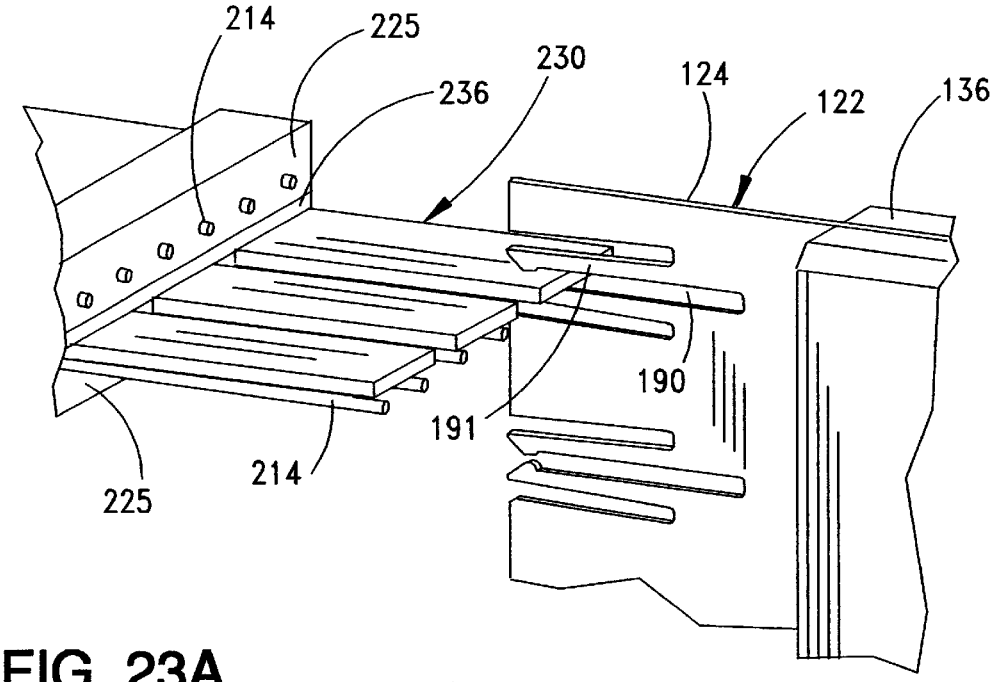
FIG. 23 is an enlarged detail perspective view illustrating the manner of engagement between the grounding shield contact portions of the plug and receptacle connectors of the connector assembly of FIG. 1.
Figure 23A:
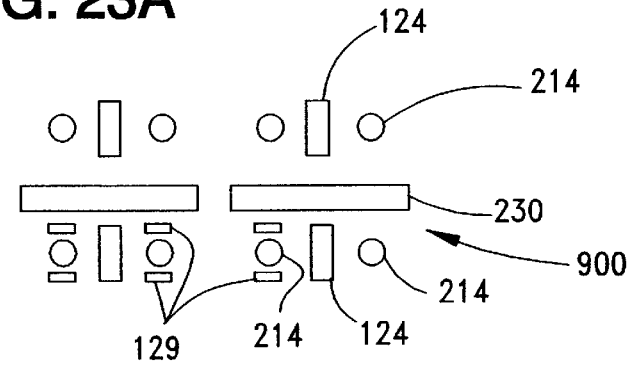
FIG. 23A is a schematic view of the contact area of FIG. 23, with the two connectors joined together.

FIGS. 22 and 23 illustrate two different plug grounding shield engagement end embodiments that show how the grounding shields of the plug and receptacle connectors of the present invention mate together. It can be seen that this engagement is a sliding engagement wherein the grounding contacts of the receptacle connector fit through openings 110 in the plug connector cover 108 and are gripped by a pair of contact arms 191 that are stamped into the contact portions thereof. In FIG. 22, the ground blades 230 of the receptacle connector terminals extend in a perpendicular fashion into the slots 190 formed between the two contact arms 191 of the plug connector ground terminal assembly. FIG. 23A illustrates in detail the "microcross" aspect of the connectors of the invention.

In FIG. 23, a receptacle connector terminal assembly is shown oriented horizontally, rather than vertically as shown in previous figures, and the plug connector terminal assembly 136 is shown oriented vertically, and the free ends of the terminal contact portions 214 have been removed for clarity. The ground member contact blades 230 are received within slots 190 located between pairs of contact arms 191. In this manner, the grounds of both connectors intersect each other in a crosswise manner and extend vertically between arrays of signal terminals and further extend horizontally between rows of terminals. This is illustrated schematically in FIG. 23A, where a cross-like pattern of grounds 900 is created in the mating area. In this mating area, the signal terminals 214 of the receptacle connector mate with their opposing female contacts 129 of the plug connector while the ground contact portions 124, 230 of each connector mate in the manner shown. This arrangement isolates the signal terminals through the intersecting ground plane, while simultaneously providing a continuous ground reference through the mating interface of the two connectors.

Alternate Terminal and Terminal Assembly Structure

Figure 24:
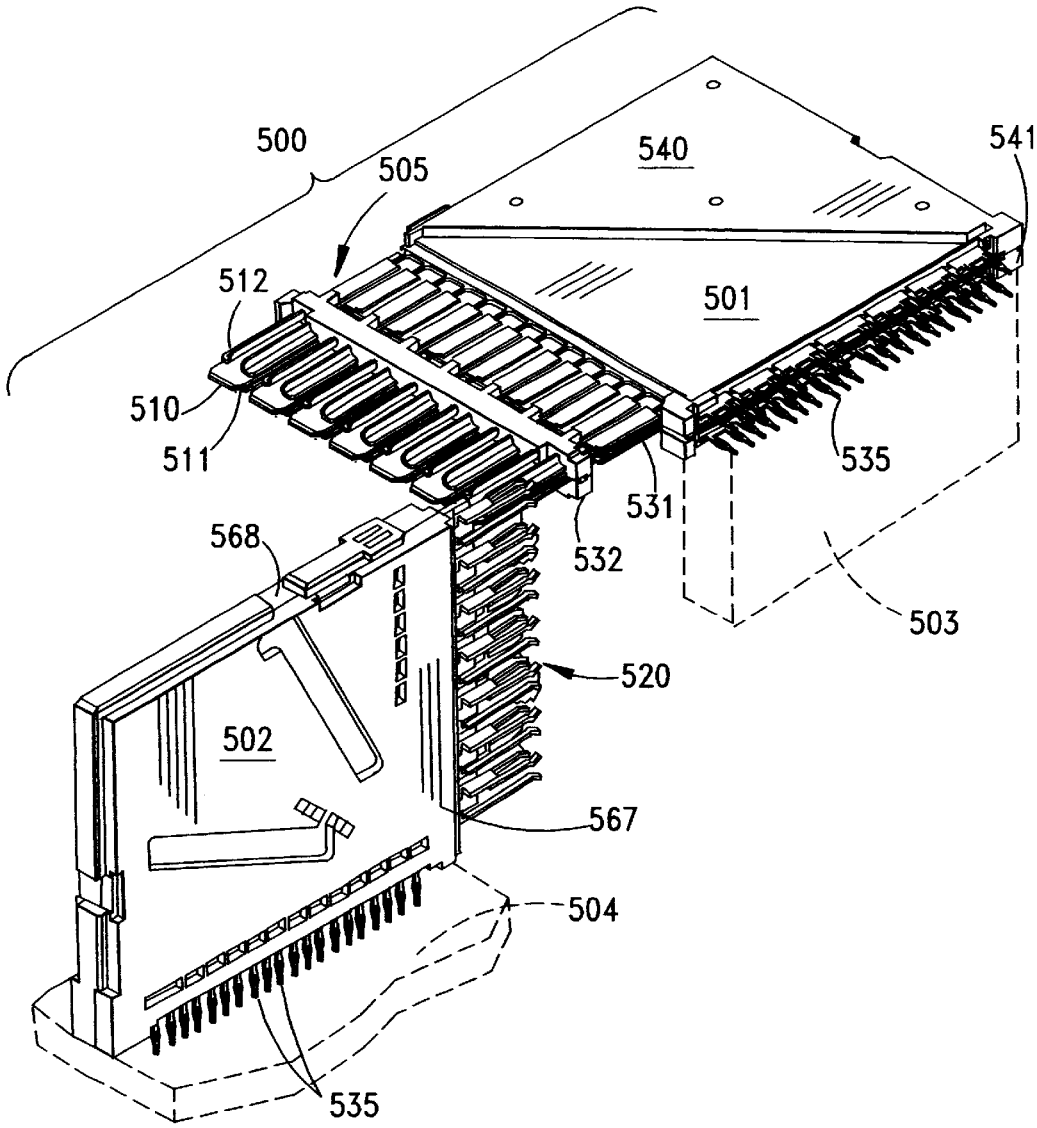
FIG. 24 is a perspective view of a pair of opposing connector wafers constructed in accordance with the principles of an alternate embodiment of the present invention and shown mated together.

FIGS. 24 through 38 illustrate another embodiment of a connector 500 constructed in accordance with the principles of the present invention. In FIG. 24, only two opposing connector assemblies 501, 502 are shown for clarity. Multiple assemblies 501, 502 are assembled together into a shroud as described above. The assemblies have terminal construction that permits them to be used to connect two circuit boards 503, 504 (shown in phantom) together in an orthogonal manner. The assemblies 501, 502 are constructed in such a manner so that at least one of them, assembly 501, has a terminal structure that can flex in both the X and Y directions, similar to that described above. Similar to the other embodiments described above, the terminals of the assembly 501 have flexural portions 505 interposed between their contact and body/tail portions that permit the contact portions of both the ground and signal terminals to flex for a preselected distance in desired directions. Hence, the assembly 501 may be referred to as the "flexible" assembly, while the terminals of assembly 502 are relatively incapable of the same flexural movement as the terminals of assembly 501, and the assembly 502 may be referred to as a "fixed" connector assembly.

Figure 28:
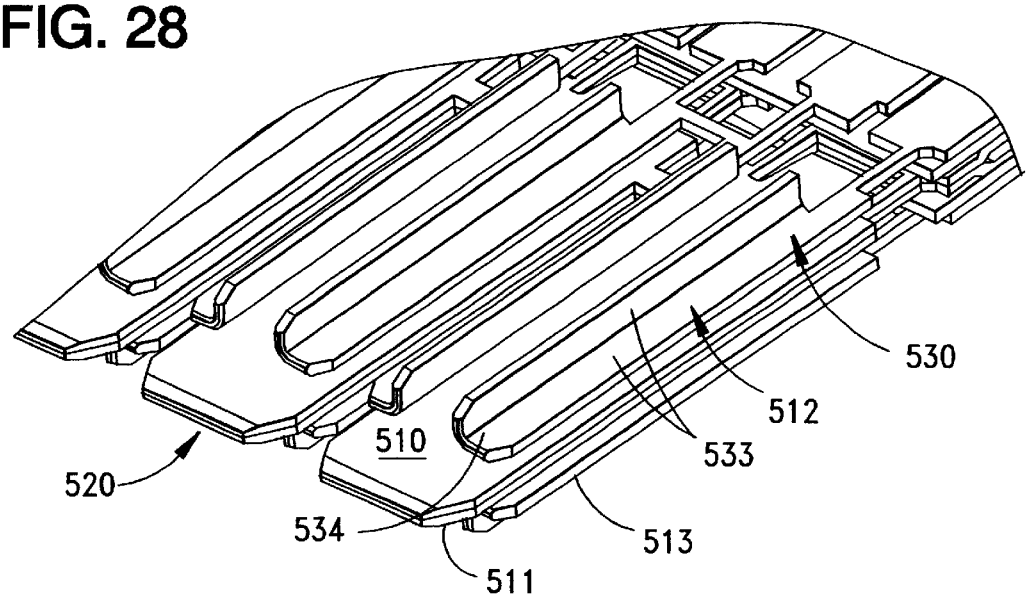
FIG. 28 is an enlarged detail view of the signal and ground terminal contact portions of the wafer assembly of FIG. 25, with its associated support bar removed for clarity.
Figure 29:
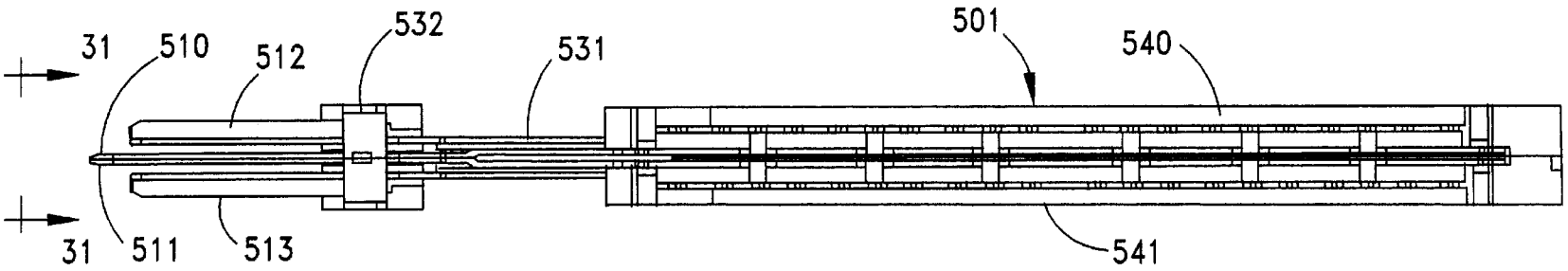
FIG. 29 is a bottom plan view of the wafer assembly of FIG. 26.
Figure 30:
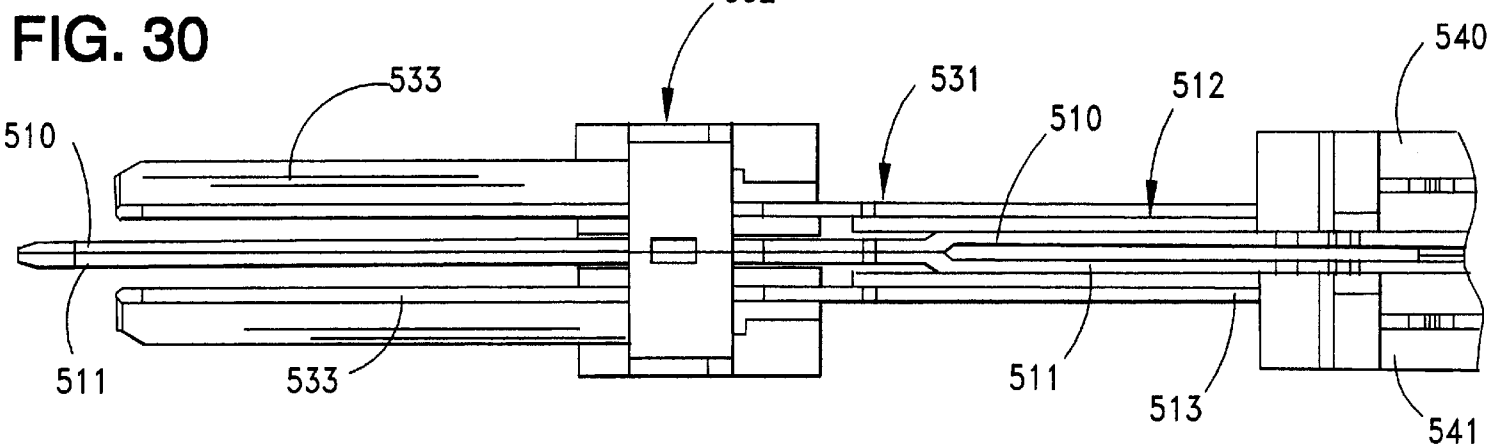
FIG. 30 is an enlarged detail view of the front, or contact, end of the wafer assembly of FIG. 29, taken along lines 30—30 thereof.
Figure 31:
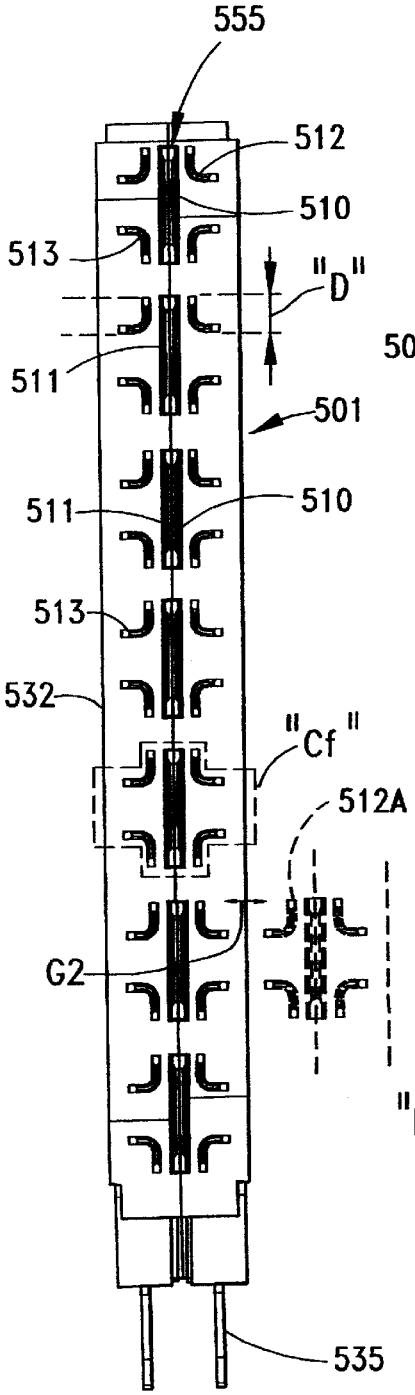
FIG. 31 is a front elevational view of the wafer assembly of FIG. 26.
Figure 32:
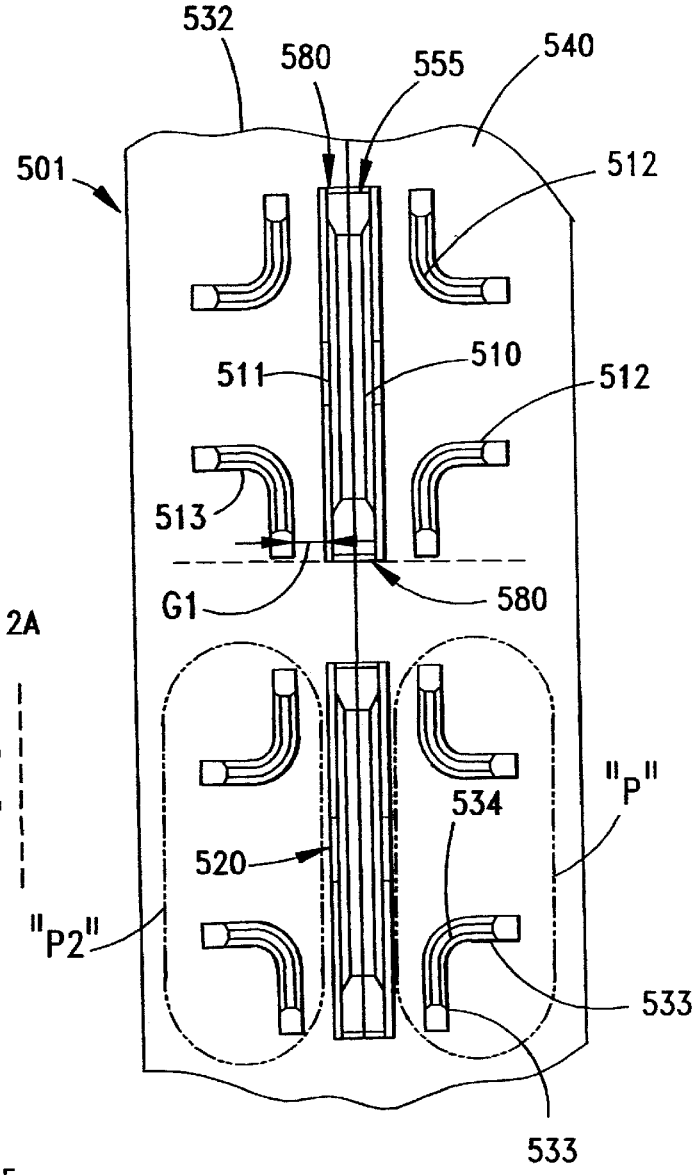
FIG. 32 is an enlarged detail view of a portion of FIG. 31.

Each of the connector assemblies may be considered as a composite of at least three, and typically four conductive sub-components. For the flexible connector assembly 501, these conductive sub-components may include (as illustrated in FIGS. 28 and 31) a first set or array, of ground terminals 510, a second set or array, of ground terminals 511, a first set, or array, of signal terminals 512 and a second set, or array, of signal terminals 513. As illustrated best in FIGS. 28, 31 and 32, the first and second sets of ground terminals are arranged together in side-by-side fashion, so that they preferably abut each other to form a single, common ground reference 520 of double thickness. (FIGS. 30, 31 & 32.) These two grounds may be considered as cooperatively forming, or defining, a center reference, or line, of the flexible connector assembly. It is also contemplated that a single ground member may be used in this application.

The first and second sets of signal terminals 512, 513 are arranged on opposite sides of the common ground 520. Preferably, it is desired that the first and second sets 512, 513 of the signal terminals are further arranged so that the terminals in the first set 512 are aligned horizontally with corresponding terminals of the second set 513 as shown in FIGS. 31 and 32. It is further desirable to space the signal terminals of both the first and second sets of terminals 512, 513 so that one pair "P" of terminals (FIG. 32) of the first set of terminals 512 is on one side of the common ground 520, and a pair "P2" of terminals of the second set of terminals 513 is on the other side of the common ground 520. In this manner a cruciform arrangement, or pattern, as shown at "CF" is formed (FIG. 31) with the common ground 520 running down the center of the pattern. Additionally, the positioning of the signal terminals 512, 513 is such that their top and bottom edges (along line "D" in FIGS. 31 & 32) are aligned with the vertical ends 580 of the common grounds 520 so that they will maintain their electrical affinity for the ground 520, rather than for each other, which is likely to occur if the tips of the signal terminals 512, 513 extend above the line D. FIG. 31 shows the tips of the signal terminals 512, 513 maintained level with the tips 580 of the grounds 520, while FIG. 32 shows the tips being positioned below the line D.

This cruciform pattern is accomplished by the structure and placement of the signal terminal contact portions 530 that extend forward of the flexural portions 531 of the terminals and the terminal support bar 532, which as described previously, is preferably formed from an insulative material and fits within a shroud or other carrier member. The terminal contact portions 530 of this terminal assembly are formed in a general L-shape with two leg portions 533 joined together at a junction 534 therebetween. As shown in the Figures, the two leg portions 533 of each signal terminal contact portion 512 extend along and away from the common ground 520 (generally parallel and perpendicular thereto). Because the two leg portions 533 are joined together, they will be characterized in this description as "solid" contact portions. The contact portions 530 and the flexural portions 531 are joined to tail portions 535 by terminal body portions supported by the insulative housing 540. The L-shape of the terminals provides strength and redundancy to the signal contact portions.

Figure 33:
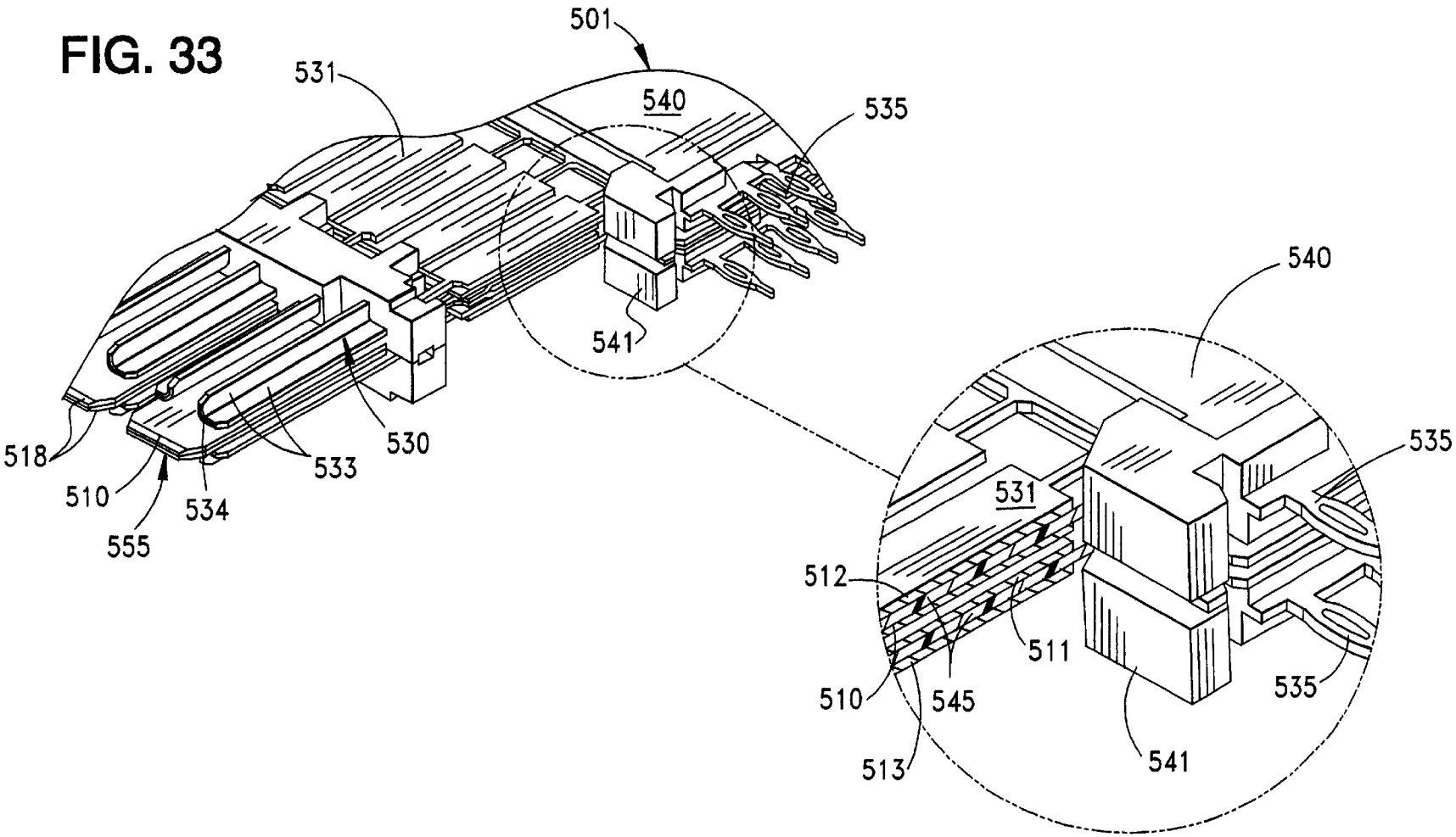
FIG. 33 is an enlarged detail view of the wafer assembly of FIG. 25, illustrating the sandwich-style layered structure thereof.
Figure 34:
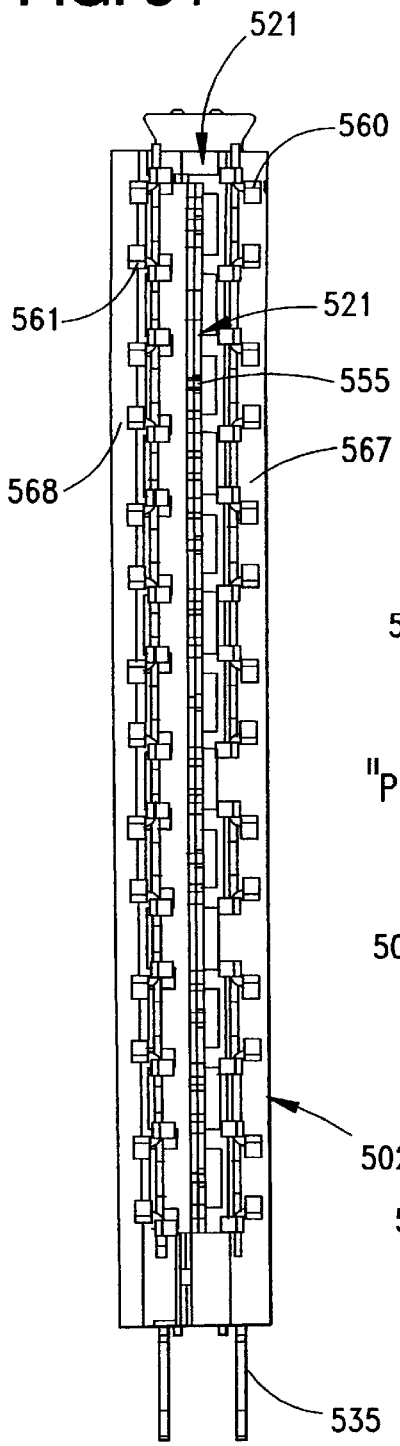
FIG. 34 is a front elevational view of the wafer assembly of FIG. 27.
Figure 35:
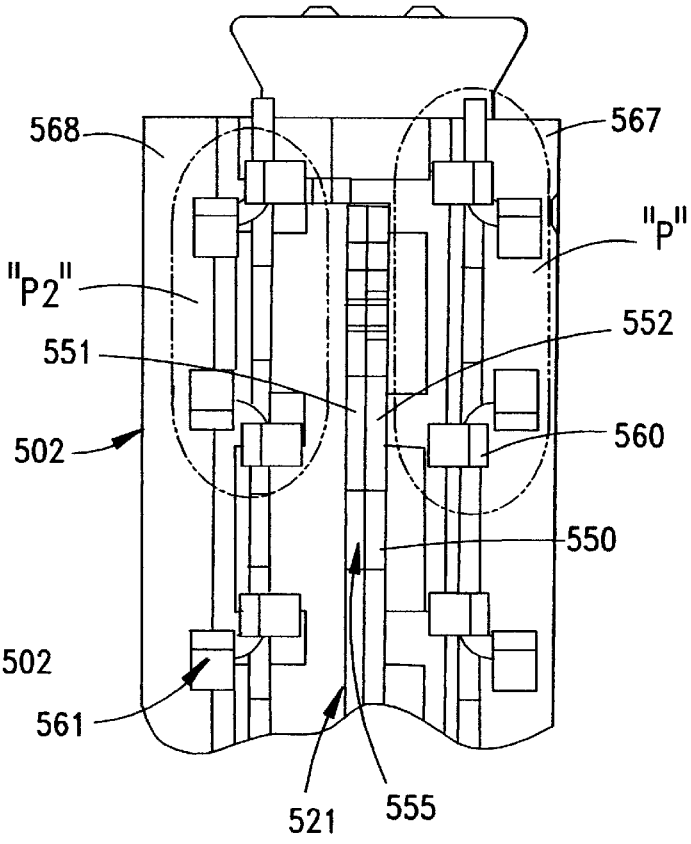
FIG. 35 is an enlarged detail view of the top portion of FIG. 34.
Figure 36:
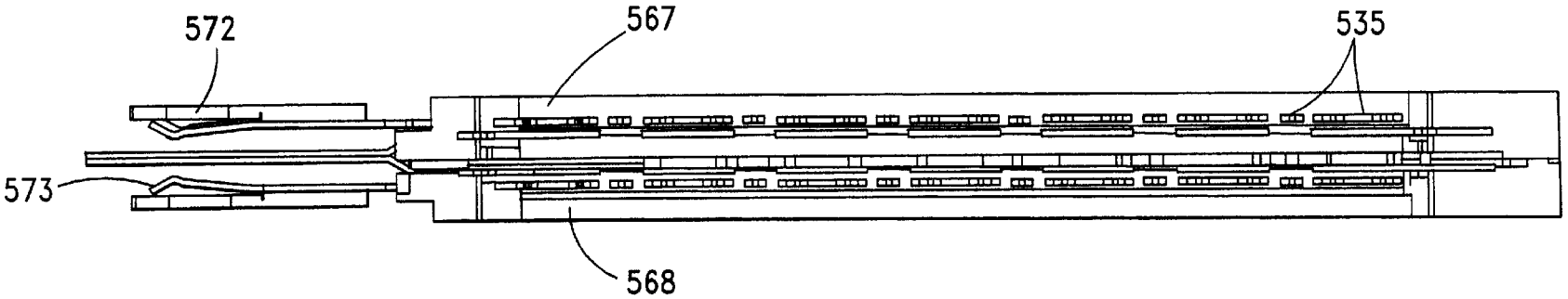
FIG. 36 is bottom plan view of the wafer assembly of FIG. 34.

FIG. 33 illustrates, in detail, the sandwiched, or layered, construction of the flexible connector assembly 501. The first and second ground terminal sets 510, 511 have contact portions that preferably take the form of flat contact blades 518 that abut each other to form the common ground 520, but they diverge away from each other in the area of the flexing portions 531 (FIG. 30) located rearwardly of the terminal support bar 532 as shown in FIG. 30. The first and second signal terminal sets 512, 513 are partially housed or enclosed within insulative bodies 540, 541 (FIGS. 29 & 30) that support, and at least partially envelop body portions of the terminals. The tail portions 535 of the terminals project from one side of these insulative bodies 540, 541 while the contact portions project from another, and preferably adjacent side thereof.

In operation, the insulative bodies 540, 541 that house the first and second sets of signal terminals 512, 513 are assembled over and on opposite sides of the first and second ground terminal sets to form the wafer-like fixed connector assembly 501. Additional insulative spacer elements 544, 545 (FIG. 33) which may be either separate elements or formed as parts or extensions of the insulative bodies 540, 541, may be provided between the first and second terminals 512, 513 and the ground terminals 510, 511 in the flexing portion area 531 to prevent unintentional shorting between the signal and ground terminals in this area and, if desired, to provide a dielectric material therebetween. As described with earlier embodiments, this entire terminal assembly may be inserted and removed as a single unit from either the plug or the receptacle connector, thereby eliminating the need for entire disassembly of the connectors for maintenance and/or repair.

Figure 27:
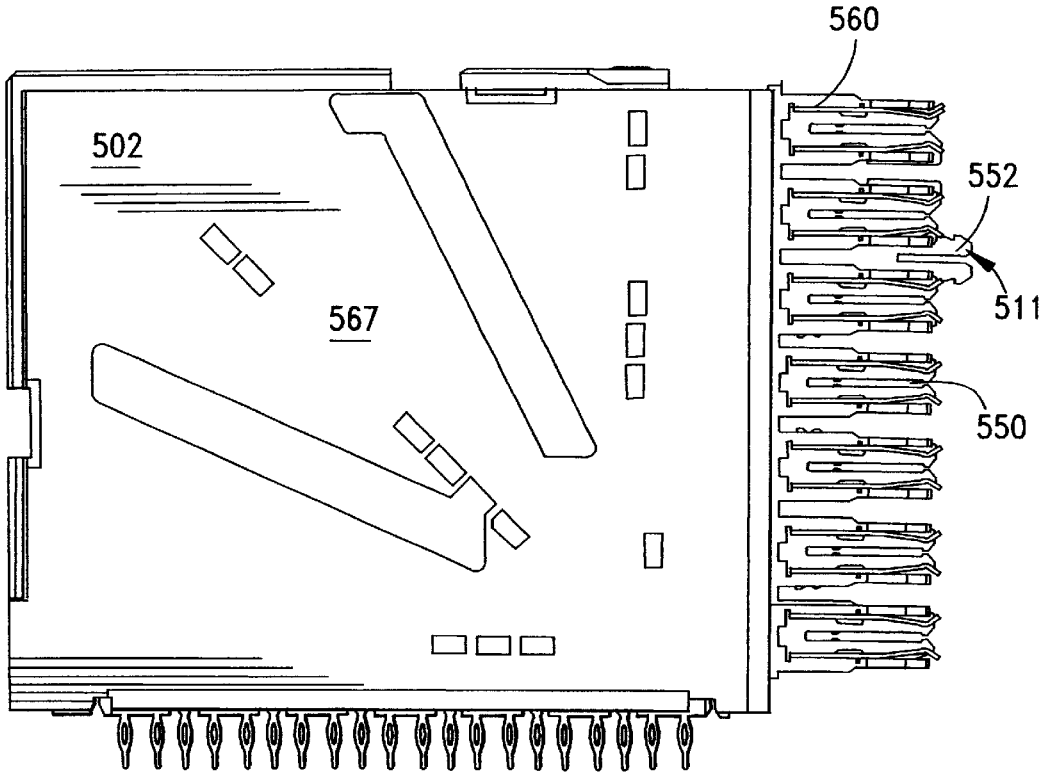
FIG. 27 is a top plan view of the leftmost wafer assembly of FIG. 24.
Figure 38:
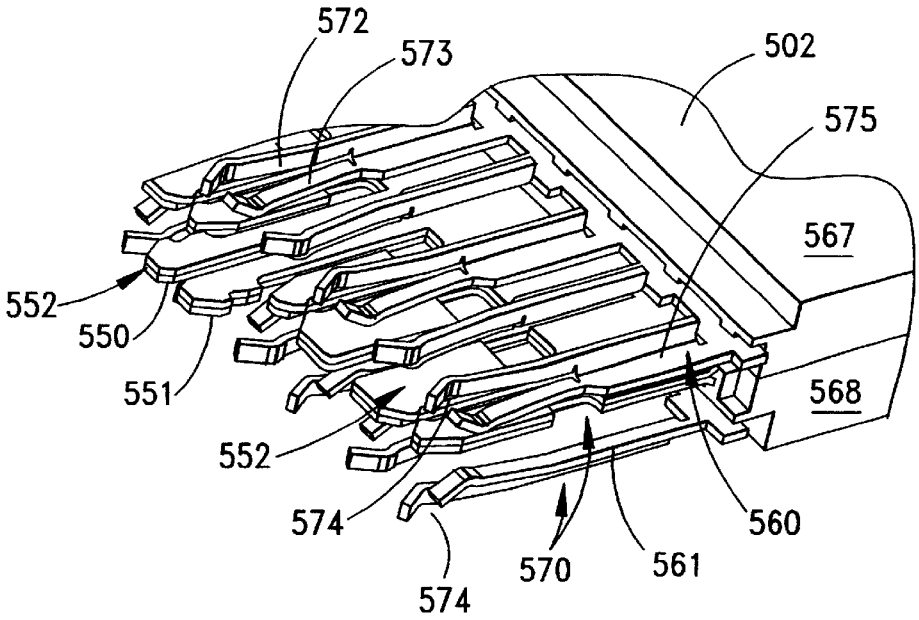
FIG. 38 is an enlarged detail view (in perspective) of the wafer assembly of FIG. 27.

The fixed connector assembly 502 also contains, as shown best in FIGS. 27 and 38, corresponding opposing terminals. These terminals include first and second sets of ground terminals 550, 551, having flat blade contact portions 552. The first and second ground terminals abut each other in the contact portion areas 552. These ground terminals combine to form a center common ground 521 that runs between the first and second signal terminal sets 560, 561, and preferably down the center of the connector assembly 502. Both of the first and second terminal sets 560, 561 are also partially enclosed by insulative bodies 567, 568 that serve to prevent unintentional shorting between the signal terminals and the ground terminals. It will be understood that, if desired, portions of the signal or ground terminals may be bent into contact with opposing ground or signal terminals as described with respect to the other embodiments of the invention.

Turning to FIG. 38, it can be seen that the contact portions 570 of the first and second terminals 560, 561 are also generally L-shaped. These contact portions differ from the "solid" contact portions 530 of the flexible connector assembly in that they include bifurcated or dual contact arms, or beams, 572, 573 that are separated by an intervening space 574. These contact arms 572, 573 extend forwardly from a body portion 575, and the contact arms 572, 573 are disposed so that one of them extend along the ground terminal blade portions, while the other of them extends away from the ground terminal blade portions (generally parallel and perpendicular thereto). These contact portions 570 are also arranged in pairs flanking each side of the common ground (FIG. 34) and the contact portions of the first set of signal terminals are preferably aligned with the contact portions of the second set of signal terminals, as represented by P and P2 in FIG. 35. They are also preferably arranged in a cruciform pattern so that they will reliably mate with the L-shaped contact portions of the flexible connector assembly. The dual contact arms are of different lengths, with one contact arm being longer then the other so that during mating, the shorter contact arm may easily deflect within the extent of the other contact arm.

Figure 37:
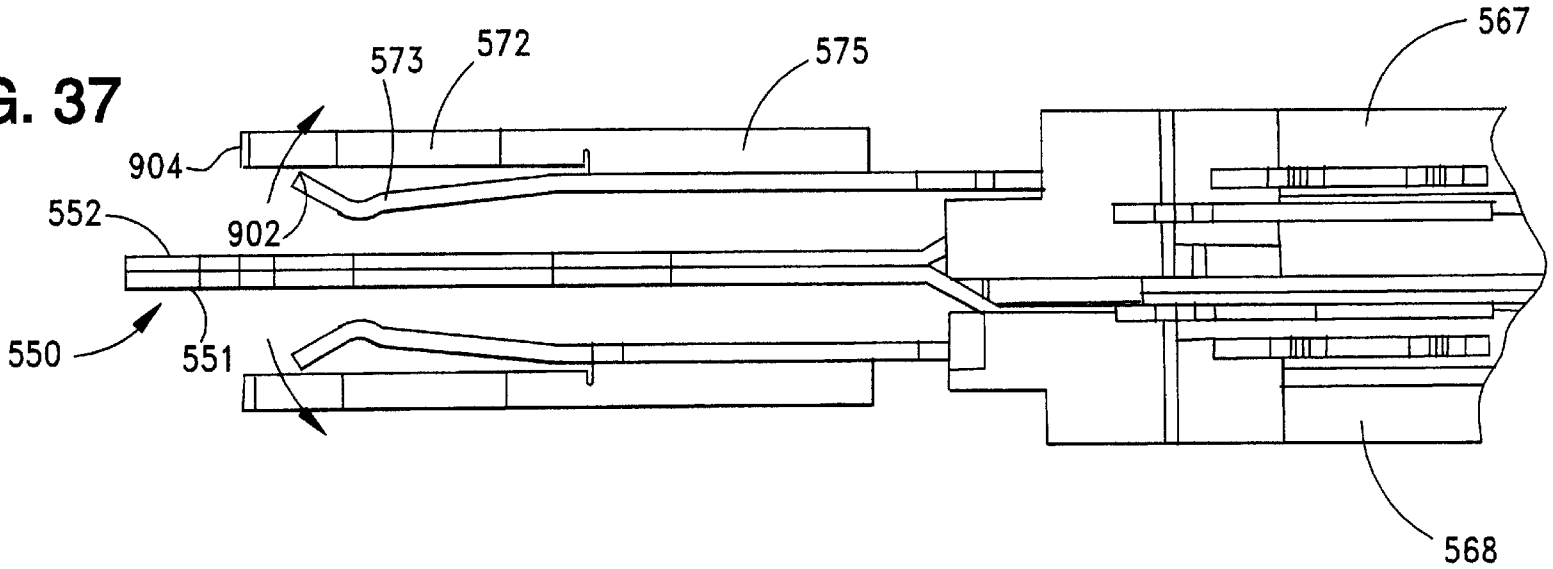
FIG. 37 is an enlarged detail view of the front end of FIG. 36.

This is illustrated best in FIGS. 37 and 38, where it can be seen that the horizontally extending contact arm portions 572 (when the terminal assembly is held upright) have a contract length that is larger than the vertically extending contact arms 573. In this regard, the free ends 902 of the one contact arms 573 are free to deflect along the paths of the arrows in FIG. 37 and move within the extent, or "cup" of the other contact arm, and not interfere with the free ends 903 of the other contact arms 572. This difference in length also affects the extent to which each contact arm deflects and reduces the peak insertion force of the connector. This reduction is obtained by one-half of the paired contact arms (the longer ones of each pair) making contact with their opposing solid contacts 530 of the receptacle connector and subsequently the shorter contact arms contacting the opposing solid contacts 530.

Figure 24B:
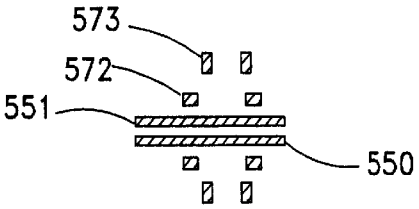
FIGS. 24B–24D are sectional views taken from FIG. 24A.
Figure 24C:
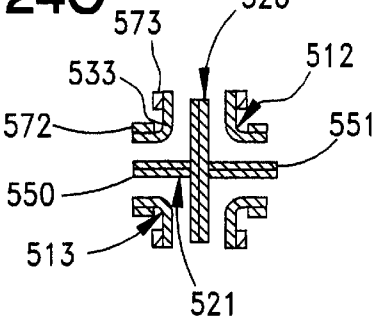
Figure 24D:
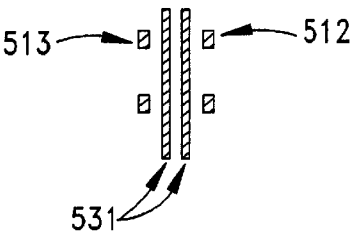
Figure 24A:
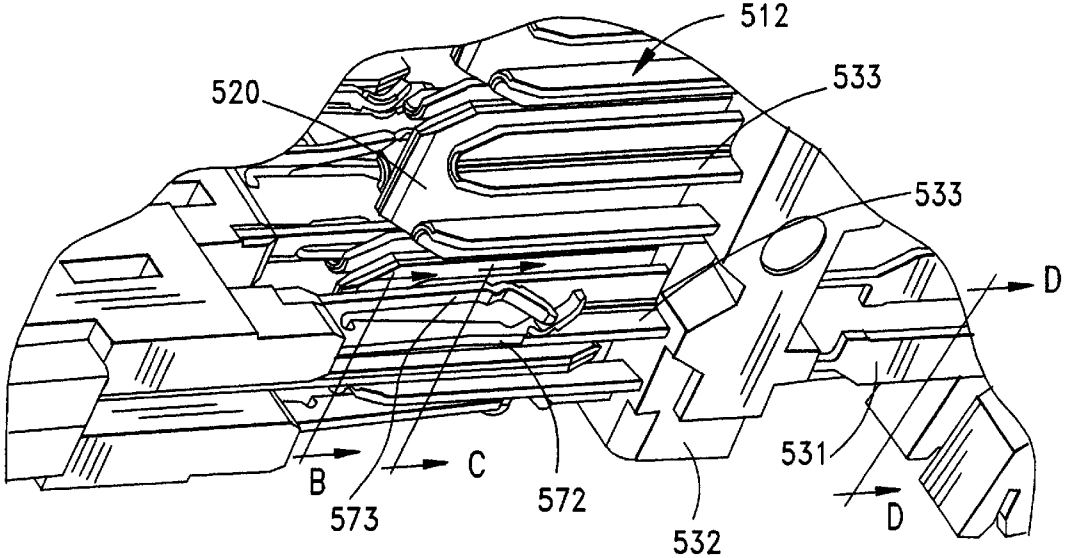
FIG. 24A is an enlarged detail view of the mating which occurs between the two connector wafers of FIG. 24.

FIG. 24A is an enlarged detail view illustrating the mating engagement of the two L-shaped contact terminal assemblies. As shown therein, the horizontal contact arm portions 572 will be the first of the two contact arm portions 572, 573 to make sliding engagement with surfaces 533 of the solid L-shaped contact beams 512. The initial peak insertion force includes only the force required to mate the longer contact arms 572 with the solid contact beams 512, instead of mating both contact arms 572, 573 at once.

This embodiment also involves the use of a "microcross" arrangement as shown in the sectional views of FIGS. 24B–24D. FIG. 24B is a sectional view taken of the four sets of terminals of the fixed terminal assembly taken along lines B—B thereof. In this section the contact arms 572, 573 are arranged as shown in an L-type orientation and spaced apart from the double ground 521. In the mating region, as shown by FIG. 24C, taken along lines C—C of FIG. 24A, the two common grounds 520, 521 of the fixed and flexing terminal assemblies intersect to form a cross, with the signal terminals of the two connector assemblies arranged as shown. In FIG. 24D, taken along lines D—D of FIG. 24A, the flexing portions are arranged in equal spacings and alignment on opposite sides of the common ground 521 of the fixed terminal assembly. In this manner, the signal terminals are maintained at a desired spacing from the ground to encourage coupling between the signal terminals and the ground.

Figure 51:
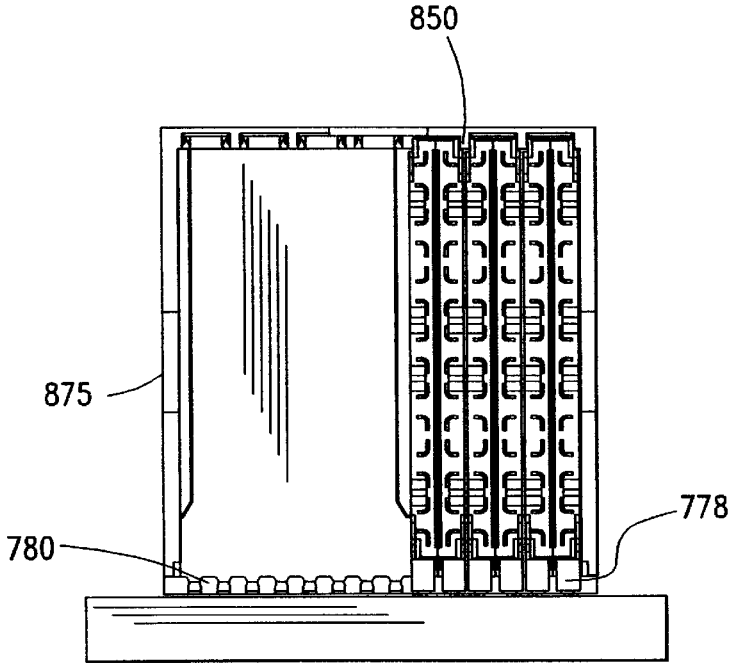
FIG. 51 is a front elevational view of FIG. 50.
Figure 52:
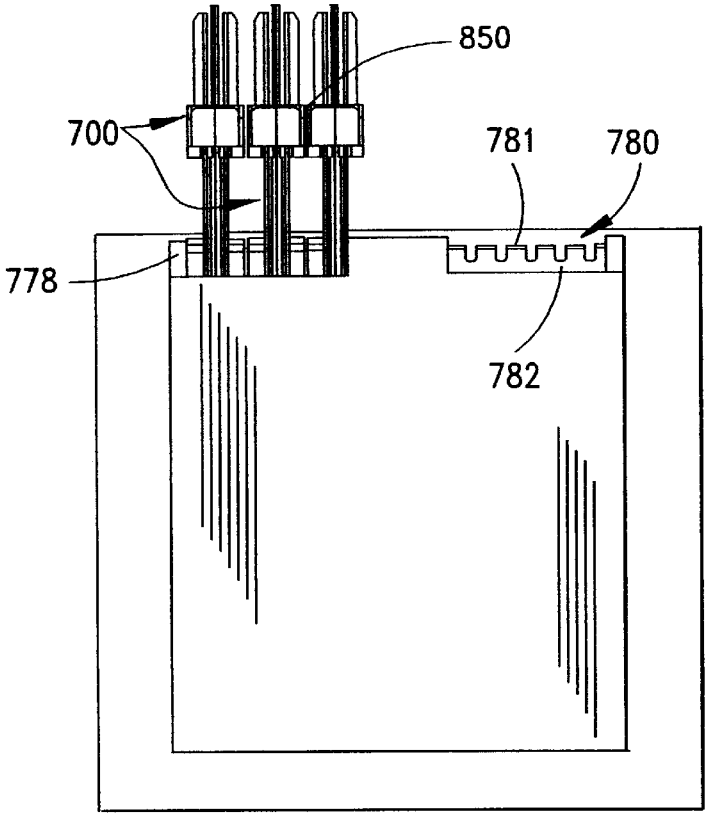
FIG. 52 is a top plan view of FIG. 45.
Figure 54:
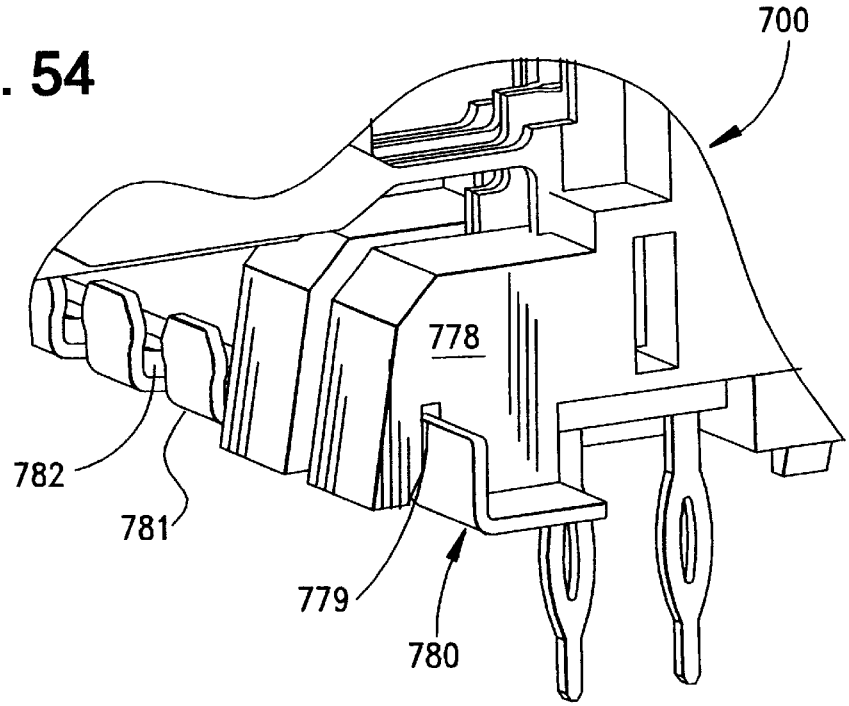
FIG. 54 is an enlarged perspective detail view of the engagement which occurs between the alignment bar and a terminal assembly.

The use of double grounds as shown is beneficial because in the body portion of the connector assemblies, the grounds are spaced apart from each other so that each such ground terminal will provide a reference for the signal terminal(s) closest to it, and will provide electrical isolation between the signal terminal(s) next to it and from that away from it, i.e., in FIG. 30, the ground terminal(s) 510 in the body portion area provides a ground reference to signal terminal(s) 512, and isolation from signal terminal(s) 513. As shown in FIGS. 31–32, the signal terminals 512, 513 may be spaced a distance "G1" from the reference grounds 520 (FIG. 32) that is less than the distance "G2" between it and a corresponding signal terminal 512A of an adjacent terminal assembly as shown in phantom in FIG. 31. This distance relationship may be further enhanced by separating the terminal assemblies from each other with an intervening space 850 as is shown in the embodiment of FIGS. 51–52. This spatial relationship encourages capacitive coupling between the signal terminals of each terminal assembly with their associated center ground, and discourages capacitive coupling between the signal terminals of one terminal assembly and the signal terminals of adjacent terminal assemblies, which would lead to crosstalk and noise during high-frequency data transmission.

Figure 41:
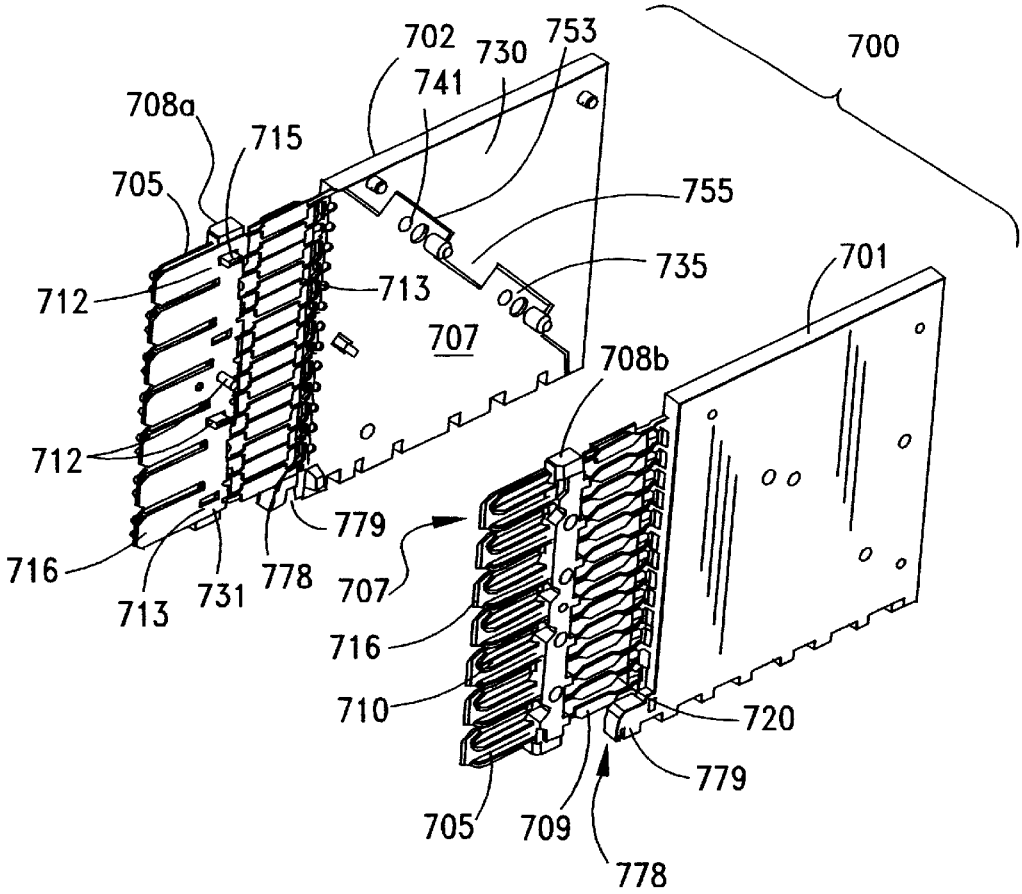
FIG. 41 is an exploded view of another terminal assembly used in receptacle connectors of the invention, but with the internal ground members assembled to each side of the terminal assembly halves and with the tail portions of the signal terminals and ground members removed for clarity.
Figure 42:
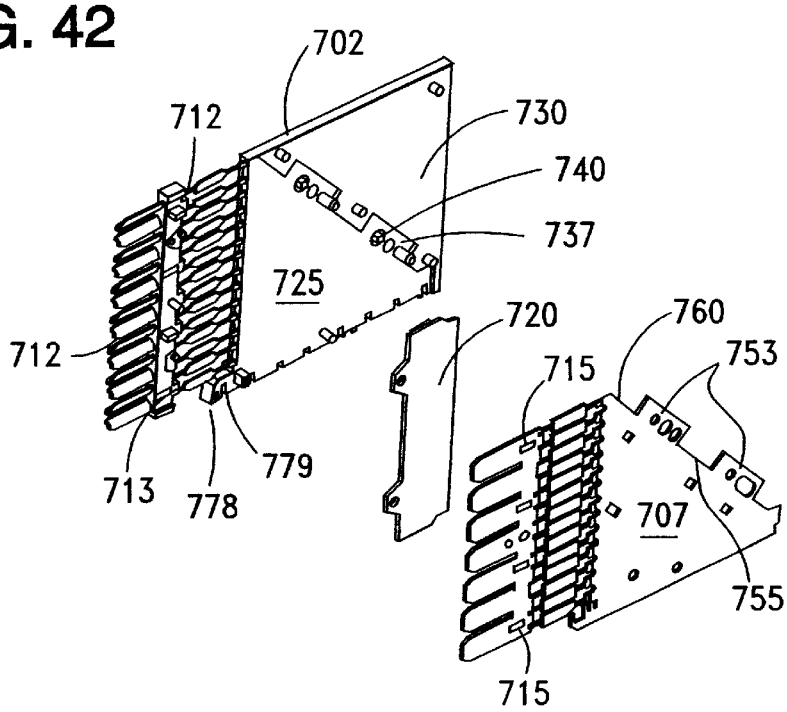
FIG. 42 is an exploded perspective view of the left, or upper terminal assembly half of FIG. 43 illustrating the assembly half, spacer element and ground member.
Figure 43:
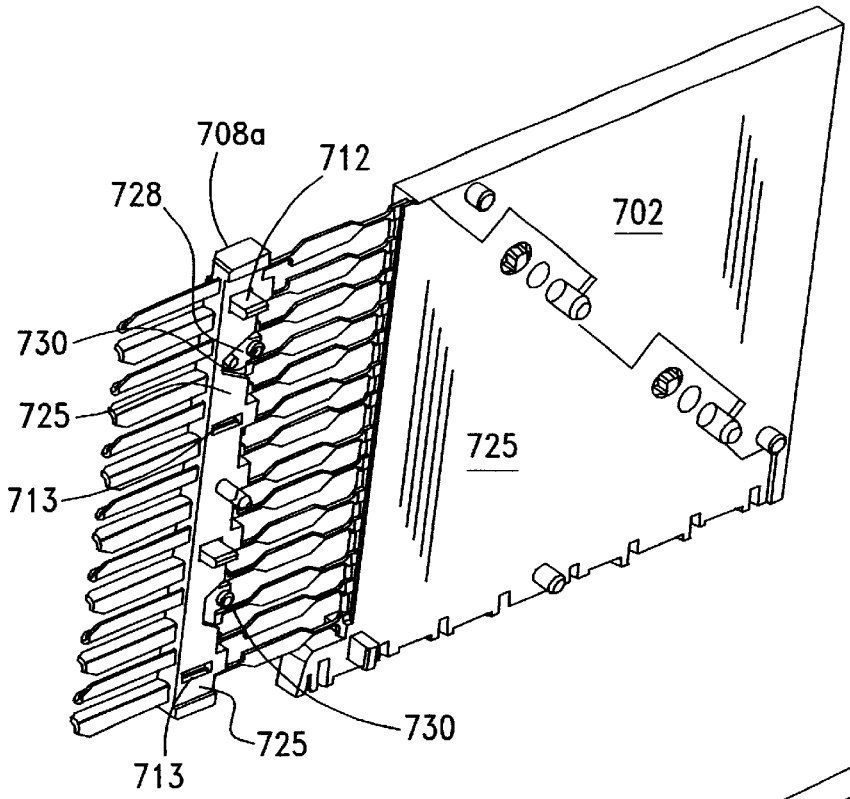
FIG. 43 is a perspective view of the leftmost signal terminal assembly half of FIG. 42, with the spacer element and ground member removed for clarity
Figure 44:
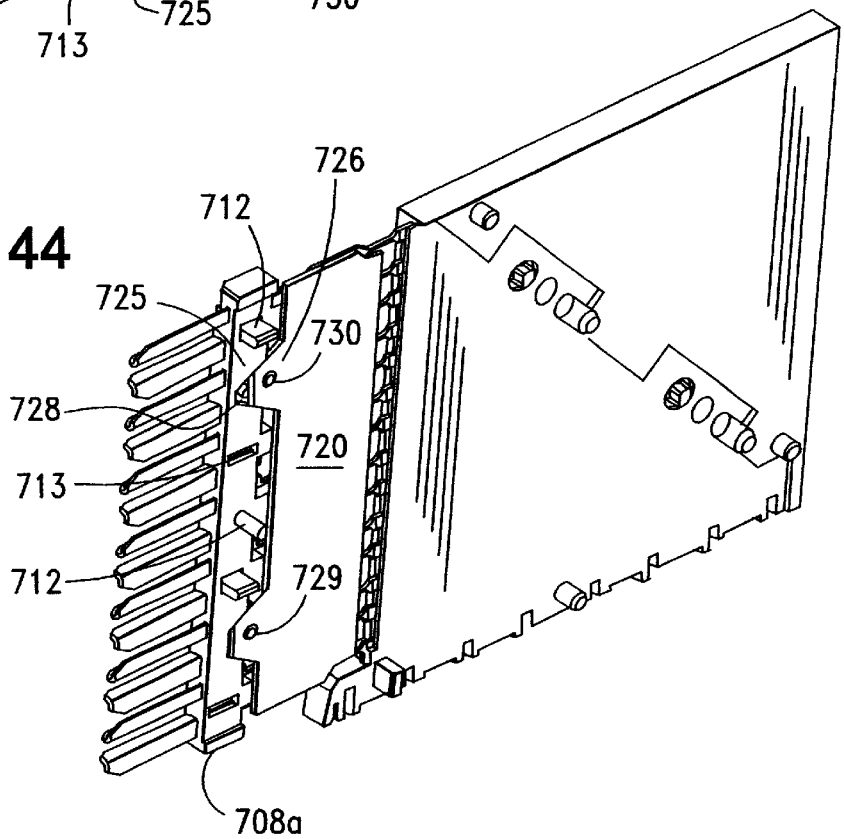
FIG. 44 is the same view as FIG. 43, but with the spacer element added.

Another embodiment of a terminal assembly constructed in accordance with the principles of the present invention is illustrated in FIGS. 41–42, where the terminal assembly 700 can be seen to be formed from two insulative halves 701, 702, each of which supports a signal terminal array 705 therein. The inner faces 730 of these assembly halves 701, 702 include recesses 725 that accommodate, as best shown in FIG. 41, the ground member 707, and particularly the flat body portion thereof. The body portion includes one or more mounting tabs 753 that are disposed along an edge 755 of the ground member body portion 707 and which are received in extensions 737 of the recesses 725. The ground member body portion 707 is generally triangular as shown and tracks the extent of the signal terminal body portions in the adjoining insulating halves 701, 702. Posts 740 and openings 741 serve to hold the ground members 707 in place prior to and during assembly, which may be accomplished by any suitable means. The ground member 707 is seen to have an angled rear edge 760 that has a length longer than any of the exterior edges of the insulating halves 701, 702 and this permits the two engagement tabs 753 to be spaced apart from other along the edge 760 a distance sufficient to provide support for the ground members 707 so that they will not move when in place between the halves 701, 702.

Terminal Assembly Retention

Figure 50:
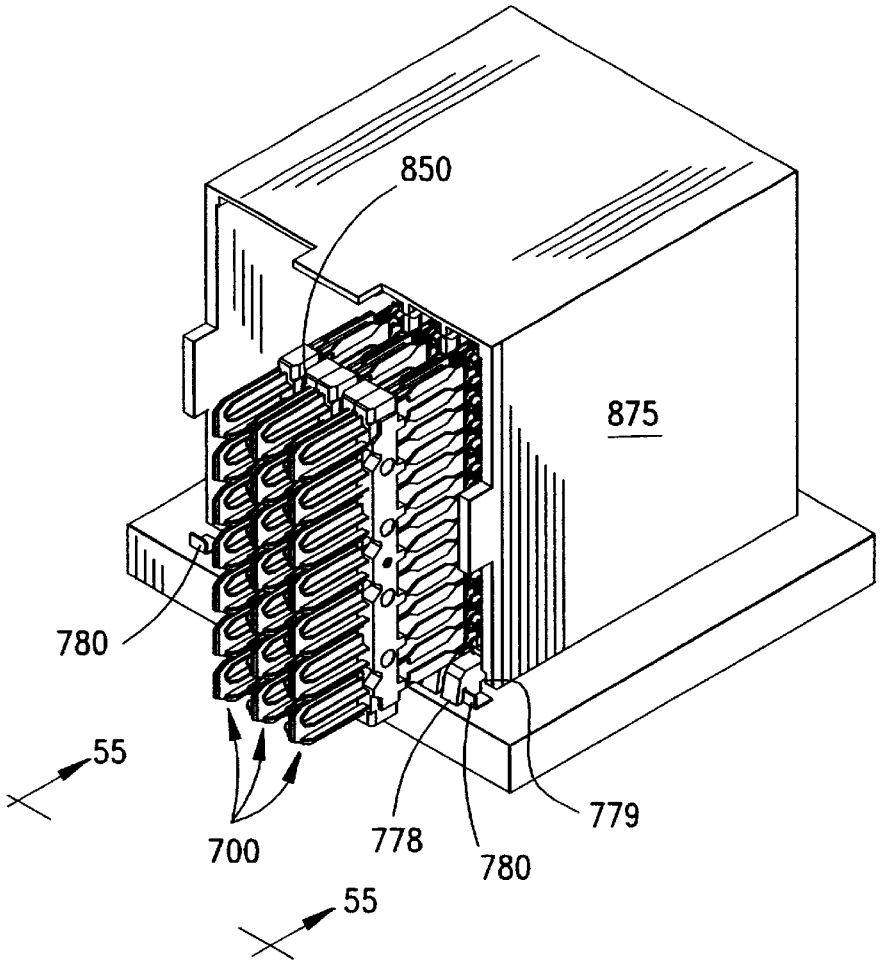
FIG. 50 is a perspective view of the embodiment of FIG. 45, with the shroud removed for clarity and illustrating the arrangement of terminal assemblies within the retainer.
Figure 53:
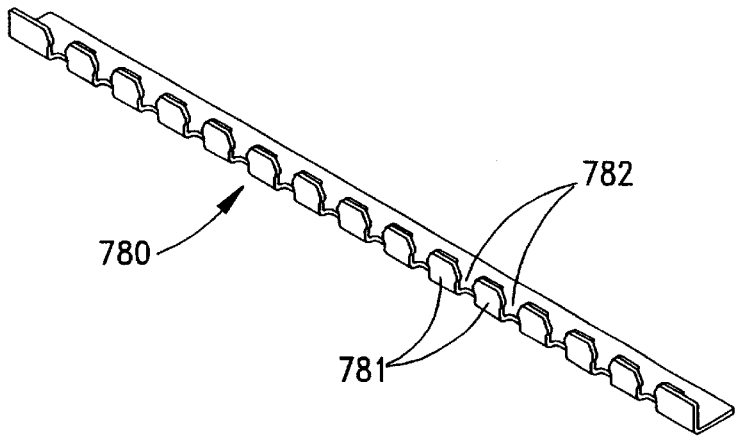
FIG. 53 is a perspective view of the connector alignmetn bar of FIG. 45.
Figure 55:
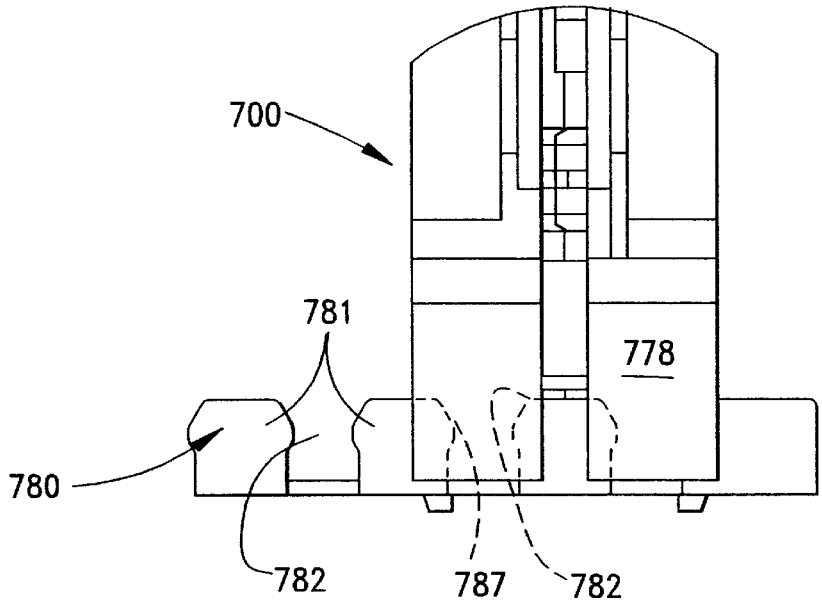
FIG. 55 is a front elevational view of FIG. 50 taken along lines 55—55 thereof, illustrating one of the terminal assemblies thereof in engagement with the alignment bar; and, FIG. 56 is a bottom plan view of the terminal assembly of FIG. 54 showing the alignment bar-receiving slot thereof.
Figure 56:
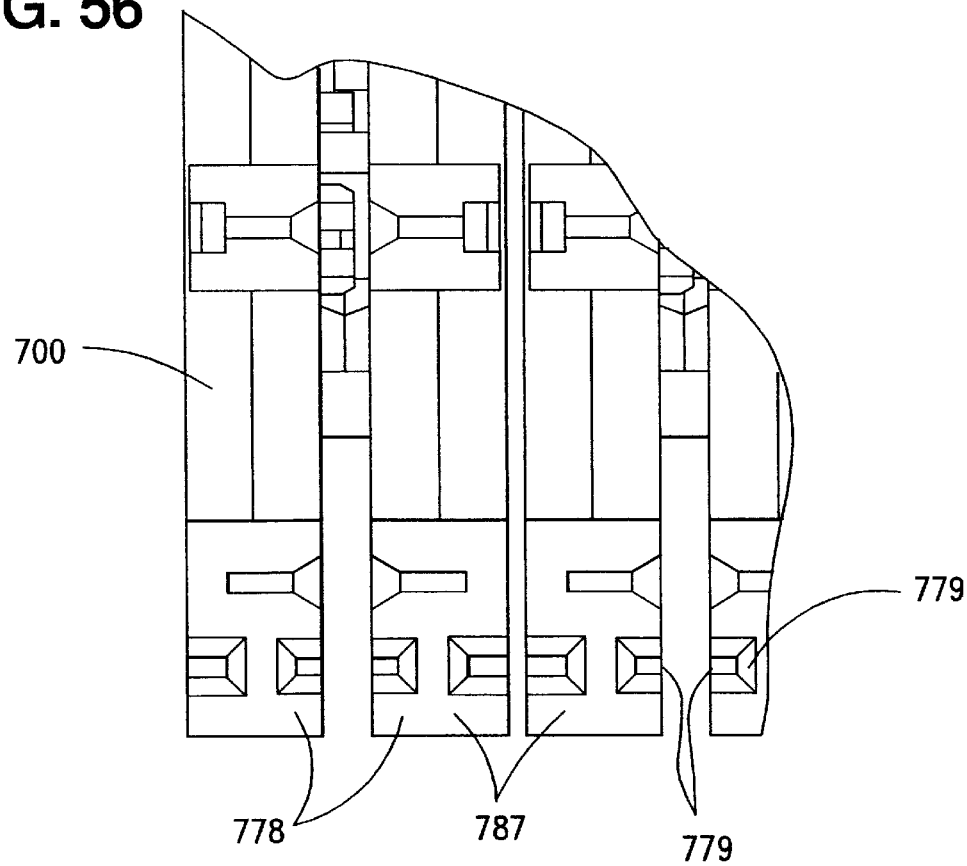

Terminal assemblies 700 of this type are shown in a state assembled into a connector in FIGS. 46–52, in which three such terminal assemblies 700 are shown assembled along the left side of a retainer 875 that takes the form of a hollow housing. The terminal assemblies are applied to the circuit board 52 so that their tail portions 775 engage holes in the circuit board 52. The terminal assemblies 700 of this embodiment also include, as best shown in FIGS. 41 and 50, a engagement lug 778 formed along its forward face and having a slot 779 formed therein. This engagement lug slot 779 engages an alignment member 780 that is formed and positioned on the circuit board 52. The alignment member 780, as shown best in FIG. 53, has a plurality of upwardly extending catches 781 that are separated by intervening slots 782. The catches 781 fit between adjacent terminal assemblies 700 and provide not only spaces 850 therebetween, but also serve to prevent the front mating ends of the terminal assemblies 700 from toeing in toward the center of the connector. The catches 781 are partially received within the terminal assembly slots 779 and extend through the intervening spacing. The slots 779 do not extend completely through the engagement lugs 778, but, as shown in FIG. 55, they preferably include a central wall 787 dividing them into two half-slots. The central walls 787 of the slots 779 are received in the intervening spaces 782 formed in the alignment bar 780.

The present invention lends itself to providing a moveable or flexing connector assembly for connecting two circuit boards together whether in an orthogonal or other orientation. Although the preferred embodiments of the invention have been described above in terms of square or rectangular connector housings, other style and types of housings may be used such as circular housings where one single support bar could be used to support a plurality of terminal contact portions to the housing in order to effect an moveable housing. Similarly, the support bars used need not be linear as shown, but may take other configurations which will accommodate non-linear arrays of terminals.

While the preferred embodiment of the invention have been shown and described, it will be apparent to those skilled in the art that changes and modifications may be made therein without departing from the spirit of the invention, the scope of which is defined by the appended claims.

What is claimed is:

1. A high density electrical connector, comprising;

a plurality of terminal assemblies, each of the terminal assemblies including at least one insulative terminal housing supporting a set of conductive terminals, the terminals having contact portions projecting from a first edge of the terminal housing and tail portions for mounting said terminal housing to a circuit board, the tail portions extending from a second edge of said housing, the terminal housing including a third edge spaced from said first edge;

a retainer for holding said terminal housings together as a unit, the retainer including at least a pair of sidewalls, the sidewalls being connected together by a plate, the retainer plate and sidewalls cooperatively defining a hollow enclosure in receiving said terminal housings, said retainer including means for engaging said terminal housing third edges; and, an alignment bar for engaging an edge of said terminal housings proximate to said first edge and spaced apart from said terminal housing third edges.

2. The connector of claim 1, when said alignment bar includes a plurality of raised ribs that project therefrom, the alignment bar ribs engaging said terminal housings and spacing them apart in a second predetermined spacing along said terminal housing second edges.

3. The connector of claim 1, wherein said terminals further include flexing portions interposed between said contact portions and said terminal housings and said retainer and alignment bar engage said terminal housings in a manner so as not to interfere with flexing of said terminal flexing portions.

4. The connector of claim 1, wherein said retainer terminal housing engagement means includes a plurality of channels formed along an inner face of said retainer plate, the channels being defined by intervening raised ribs that project into the interior of said retainer, the channels spacing said terminal housing apart in a first predetermined spacing along said terminal housing third edges.

5. The connector of claim 4, when said alignment bar includes a plurality of raised ribs that project therefrom, the alignment ribs engaging said terminal housings and spacing them apart in a second predetermined spacing along said terminal housing second edges.

6. The connector of claim 5, wherein said first and second spacings are equal.

7. The connector of claim 1, wherein said alignment bar includes a plurality of ribs projecting therefrom, the alignment bar ribs being separated from each other by intervening spaces, and said terminal housings include slots formed along said second edges thereof, said terminal housing slots receiving said alignment bar ribs therein.

8. The connector of claim 7, wherein said retainer terminal housing engagement means includes a plurality of channels formed along an interior surface thereof, each of the channels receiving therein a single terminal housing, said channels being aligned with said alignment bar intervening slots to hold terminal housings upright within said retainer.

9. The connector of claim 7, wherein said terminal housing slots are disposed in said terminal housing second edges proximate to said terminal housing first edges and exterior of said retainer.

10. The connector of claim 7, wherein said terminal housings each include a body portion and said terminal housing slots are disposed in the body portions thereof and extend transversely across said first edges thereof.

11. The connector of claim 10, wherein said terminal housings slots each include a wall portion extending across said terminal housing slot and dividing said terminal housing slots into two portions, said wall portions being received within said alignment bar intervening spaces when said alignment bar is engaged with said terminal housings.

12. The connector of claim 1, wherein each terminal assembly includes at least one set of signal terminals and one set of ground terminals, and said terminal housings each include a pair of terminal housing halves which are joined together to form single terminal housings.

13. The connector of claim 12, wherein for each terminal housing, one of said terminal housing halves supports said one signal terminal set and said ground terminal set is held between said terminal housing halves.

14. The connector of claim 1, wherein each terminal assembly includes a pair of signal terminal sets and a pair of ground terminal sets, each of said terminal housings including a pair of terminal housing halves which are joined together, each terminal housing half supporting a single signal terminal set and said two ground terminal sets being held between said terminal housing halves and spaced apart from said two signal terminal sets.

15. The connector of claim 14, wherein said two ground terminal sets are held together in side-by-side order to form a single ground member of double thickness.

16. A connector retainer assembly in a connector formed from a plurality of individual terminal assemblies, each terminal assembly including a plurality of conductive terminals supported on an insulative housing, comprising:

first means for aligning said terminal assemblies formed in said terminal housings cooperatively and extending in a direction transverse to axial directions of said terminals;

an elongated alignment member that engages said first terminal housing alignment means along first edges of said terminal housings that maintain the terminal housing first edges in a first predetermined spacing; and, a hollow retainer that partially encloses said terminal housings, the retainer including second means for aligning said terminal assemblies, the second terminal housing alignment means engaging said terminal housings along second edges thereof and maintains the terminal housing second edges in a second predetermined spacing.

17. The connector retainer assembly of claim 16, wherein said terminal assembly first alignment means includes a plurality of slots formed along said terminal housing first edges and said terminal assembly second alignment means including a plurality of slots formed along an inner surface of said retainer, each slot receiving at least a portion of a single terminal housing second edge therein.

18. The connector retainer assembly of claim 17, wherein said alignment member includes a plurality of engagement lugs that are received within said terminal housing slots.

19. The connector retainer assembly of claim 18, wherein said terminal housing slots are divided by central walls and said alignment member includes a plurality of spaces interposed between said engagement lugs thereof, the terminal housing slot central walls being received within said alignment member spaces.

* * * * *